US012410692B1

(12) United States Patent
Juenke

(10) Patent No.: US 12,410,692 B1
(45) Date of Patent: Sep. 9, 2025

(54) GAS INJECTION VALVE WITH PRESSURE-ISOLATED BELLOWS

(71) Applicant: Liberty Lift Solutions, LLC, Houston, TX (US)

(72) Inventor: Michael S. Juenke, Spring, TX (US)

(73) Assignee: Libert Lift Solutions, LLC, Houston, TX (US)

( * ) Notice: Subject to any disclaimer, the term of this patent is extended or adjusted under 35 U.S.C. 154(b) by 131 days.

(21) Appl. No.: 18/386,012

(22) Filed: Nov. 1, 2023

Related U.S. Application Data

(60) Provisional application No. 63/531,140, filed on Aug. 7, 2023.

(51) Int. Cl.
*E21B 43/12* (2006.01)
*E21B 43/16* (2006.01)

(52) U.S. Cl.
CPC ..... *E21B 43/123* (2013.01); *E21B 43/16* (2013.01); *E21B 2200/02* (2020.05)

(58) Field of Classification Search
CPC .... E21B 2200/02; E21B 43/16; E21B 43/162; E21B 43/164
See application file for complete search history.

(56) References Cited

U.S. PATENT DOCUMENTS 2,339,487 A 1/1944 King
3,575,194 A * 4/1971 McMurry ..... E21B 43/123 137/155
3,601,191 A * 8/1971 McMurry ..... E21B 43/123 417/115
4,625,941 A * 12/1986 Johnson ..... E21B 43/123 417/112
11,242,732 B2 2/2022 Salihbegovic
2021/0340848 A1* 11/2021 Salihbegovic ..... E21B 43/123
2022/0307354 A1 9/2022 Salihbegovic

OTHER PUBLICATIONS

*Tubing Retrievable Fortress High Performance Injection Pressure Operated Gas Lift Valves*, ELC Energy (2022).

* cited by examiner

*Primary Examiner* — Kelsey E Cary
(74) *Attorney, Agent, or Firm* — McAughan Deaver PLLC

(57) ABSTRACT

A gas control valve has a bellows, a sealed upper chamber, a lower chamber open to ambient pressure, and upper and lower seals. The valve is placed in its open and closed states as the bellows expands and collapses in response to the difference in effective fluid pressure in the sealed and open chambers. The sealed chamber is filled with liquid and compressed gas. The liquid fills a lower portion of the sealed chamber that extends either around the exterior of the bellows or into the interior of the bellows. Gas fills an upper portion of the sealed chamber. The upper seal provides a seal to isolate liquid in the lower portion of the sealed chamber from fluid pressure in the upper portion of the sealed chamber. The lower seal isolates the bellows from ambient fluid pressure.

23 Claims, 10 Drawing Sheets

GAS INJECTION VALVE WITH PRESSURE-ISOLATED BELLOWS

FIELD OF THE INVENTION

The present invention relates generally to downhole valves for controlling the flow of gas through artificial lift systems and to systems for assisting production from oil and gas wells by gas injection, and especially to downhole valves and systems for injecting gas into a liquid production stream.

BACKGROUND OF THE INVENTION

Hydrocarbons, such as oil and gas, may be recovered from various types of subsurface geological formations. The formations typically consist of a porous layer, such as limestone and sands, overlaid by a nonporous layer. Hydrocarbons cannot rise through the nonporous layer. Thus, the porous layer forms a reservoir, that is, a volume in which hydrocarbons accumulate. A well is drilled through the earth until the hydrocarbon bearing formation is reached. Hydrocarbons then are able to flow from the porous formation into the well.

In the most basic form of rotary drilling methods, a drill bit is attached to a series of pipe sections or "joints" referred to as a drill string. The drill string is suspended from a derrick and rotated by a motor in the derrick. A drilling fluid or "mud" is pumped down the drill string, through the bit, and into the bore of the well. This fluid serves to lubricate the bit. The drilling mud also carries cuttings from the drilling process back to the surface as it travels up the wellbore. As the drilling progresses downward, the drill string is extended by adding more joints of pipe.

The well will be drilled to a certain depth. Large diameter pipes, or casings, are placed in the well and cemented in place to prevent the sides of the borehole from caving in. The casing is cemented in the well by injecting a cement slurry down the casing and out the bottom of the casing. The slurry then will flow up into the well annulus, that is, the gap between the casing and the bore of the well. The cement will harden into a continuous seal throughout the annulus.

After the initial section has been drilled, cased, and cemented, drilling may proceed with a somewhat smaller wellbore. The smaller bore is lined with large, but somewhat smaller pipes or "liners." The liner is suspended from the original or "host" casing by an anchor or "hanger." A well may include a series of smaller liners, and may extend for many thousands of feet, commonly up to and over 25,000 feet.

Hydrocarbons, however, are not always able to flow easily from a formation to a well. Some subsurface formations, such as sandstone, are very porous. Hydrocarbons can flow easily from the formation into a well. Other formations, however, such as shale rock, limestone, and coal beds, are only minimally porous. The formation may contain large quantities of hydrocarbons, but production through a conventional well may not be commercially practical because hydrocarbons flow though the formation and collect in the 8 well at very low rates. The industry, therefore, relies on various techniques for improving the well and stimulating production from formations and especially from formations that are relatively nonporous.

Perhaps the most important stimulation technique is the combination of horizontal wellbores and hydraulic fracturing. A well will be drilled vertically until it approaches a formation. It then will be diverted, and drilled in a more or less horizontal direction, so that the borehole extends along the formation instead of passing through it. More of the formation is exposed to the borehole, and the average distance hydrocarbons must flow to reach the well is decreased. Fractures then are created in the formation which will allow hydrocarbons to flow more easily from the formation.

Fracturing a formation is accomplished by pumping fluid, most commonly water, into the well at high pressure and flow rates. Proppants, such as grains of sand, ceramic or other particulates, usually are added to the fluid along with gelling agents to create a slurry. The slurry is forced into the formation at rates faster than can be accepted by the existing pores, fractures, faults, vugs, caverns, or other spaces within the formation. Pressure builds rapidly to the point where the formation fails and begins to fracture. Continued pumping of fluid into the formation will tend to cause the initial fractures to widen and extend further away from the wellbore, creating flow paths to the well. The proppant serves to prevent fractures from closing when pumping is stopped.

Once the drilling phase is over, the well will be completed by installing equipment that will enable the formation to be fractured and allow fluids to be produced from the well in a controlled fashion. Production of natural gas is relatively easy to manage. Natural gas is predominantly methane, which is lighter than air and much lighter than liquids produced by the well. It rises naturally through the well. Other gaseous hydrocarbons, though somewhat heavier than air, are still much lighter than produced liquids and are easily pushed up and out of the well. Liquid hydrocarbons, that is oil, is much heavier than natural gas. Ideally, however, the hydrostatic pressure of fluids within the pores of a formation, the "formation pressure," also will be sufficiently high to push oil flowing into the bottom of the well all the way to the surface.

In many wells, at least initially, that is the case. Oil will flow from the formation, into the production casing, and up through flow control equipment at the surface. Over time as production continues, however, the formation pressure will drop. If the well has been fractured, the formation will start to relax, closing many of the fractures and making it harder for fluids to flow into the well. Production of natural gas will continue, but eventually the bottom hole pressure, that is, the hydrostatic pressure urging fluids upward through the casing is no longer sufficiently high to push oil all the way to the surface. At that point, a well operator will have to resort to one or more techniques to assist in lifting oil out of the well.

Such "artificial lift" systems include the iconic "rocking horse" or walking beam system. Other artificial lift systems utilize an electric motor that is installed in the well and connected to a downhole pump. It may be a reciprocating or progressive cavity pump, but more commonly the downhole pump is an electric submersible pump ("ESP"). "Gas lift" is another common form of artificial lift.

Gas lift systems—in one fashion or another-use natural gas to assist in moving oil to the surface. As compared to other systems for artificial lift, they tend to be more flexible and trouble free. Gas lift systems do not incorporate downhole motors or mechanical pumps, and instead are controlled and operated by valves. Surface equipment, such as field compressors, also can be shared among several wells. Moreover, gas lift systems can accommodate a wide range of production rates. Different gas lift techniques—such as continuous gas lift, intermittent gas lift, plunger-assisted lift, and gas pumps—may be employed over the life of a well as production is depleted.

Each of those gas lift techniques offers distinctly different capabilities while presenting different installation and maintenance issues. Cumulatively, they may greatly extend the period of time over which production from the well is economically feasible. Continuous gas injection, however, is almost universally the first part of any plan for producing a well with gas lift.

For example, once the formation pressure is no longer high enough to push oil all the way to the surface, operators often turn to continuous gas lift. A smaller diameter pipe or "production tube" is installed in the casing to convey oil to the surface. Natural gas, typically a portion of the natural gas produced by the well, then is pumped into the annulus between the production tube and the casing. Gas flows through a valve into the production tube. The injected gas "lightens" the column of oil in the tubing. That is, the oil will be infused with gas, reducing its density, and reducing the hydrostatic pressure of fluid in the tubing below that of the formation pressure. Liquids will again be able to flow to the surface.

Most gas injection valves operate in response to ambient pressure, most commonly, gas pressure in the annulus. Gas enters the valve through an inlet open to the annulus. A valve seat is provided in a flow path between the valve inlet and an outlet discharging into the production tube. A valve body is biased onto the valve seat so that the valve is normally closed. When pressure in the annulus is sufficiently high, it overcomes the biasing force on the valve body. The valve body is lifted off the valve seat, opening the valve. Gas flows into the production string and performs the work of lifting liquids to the surface.

The most common gas injection valves use a pressure-responsive bellows to apply a biasing force to the valve body. The bellows is exposed on one side to pressure in a sealed chamber in the valve housing and on the other side, via the gas inlet, to pressure in the annulus. The pressure chamber is charged with a gas, typically nitrogen, to provide a predetermined actuating pressure. As pressure in the annulus varies, the bellows will expand and contract axially, that is, it will increase and decrease in length. The valve body is coupled to the bellows by a valve stem. Thus, as the bellows expands and contracts, it will pull and push the valve stem up and down. The valve body will be seated, and the valve closed unless and until pressure in the annulus exceeds the valve actuating pressure.

Significant advances have been made in the design of bellows used in gas injection valves. Despite their relatively thin-walled construction, they may be capable of withstanding pressure differentials of 600 psi or more. In that sense, the bellows are remarkably tough. Once placed in service, however, they will be exposed to well fluids that can be corrosive and may contain significant amounts of particulates. Bottom hole temperatures are elevated. Well fluids commonly have temperatures in excess of 200° F., perhaps in excess of 450° F. The bellows may experience corrosion. Particulates May accumulate and hinder them in operating as designed, especially over extended periods of exposure.

Relying on bellows also becomes more problematic as an injection valve is installed at deeper depths in deeper wells. Managing the effects of pressure differentials across the bellows is more challenging. Ambient pressure in the annulus can be much greater than the pressure at which the valve was charged, perhaps an order of magnitude greater. Stem stops and the valve body will limit the extent to which the bellows can expand or collapse axially in response to such pressure differentials. Gas in the sealed chamber, however, will continue to compress in response to increasing ambient pressure. The bellows may deform radially as the pressure differential between its interior and exterior sides increases. Despite recent advances in their design, the stress created by radial deformation can cause the bellows to fail, especially if there are any manufacturing defects present in the bellows.

Various design features may be incorporated to minimize or protect the bellows from deforming radially. Providing a close tolerance between the exterior of the bellows and the valve housing can be used to limit somewhat the extent to which the bellows can expand radially. Close tolerances also may be used in designs in which the valve stem extends within the bellows. A closely fitting valve stem will help resist excessive radial collapse.

Some gas lift valves also provide "hydraulic protection." That is, a liquid plug is introduced along with compressed gas into the sealed pressure chamber. When the valve is installed, it will be oriented substantially vertically with the pressure chamber on the upper end of the valve, above the bellows. The liquid plug sinks to the bottom of the pressure chamber and envelopes the bellows. As the bellows expands in response to pressure exceeding the actuation pressure, a seal will be established. The seal is established above the bellows. It isolates liquid surrounding the bellows from the upper, gas filled portion of the sealed pressure chamber.

The liquid in theory is incompressible and will not allow further expansion, and potential damage to the bellows, in response to increasing fluid pressure inside the bellows. In practice, however, and especially given that the chamber will be charged to pressures significantly higher than ambient surface pressures, significant amounts of gas can become dissolved in the liquid. That gas will be further compressed in response to increasing pressure within the bellows. The bellows thus may expand and be damaged by increasing pressure inside the bellows.

Other gas lift valves have incorporated a seal between the valve housing and the valve stem. The seal isolates the bellows from ambient fluid pressure. Thus, pressure buildup within or around the bellows, as the case may be, will be limited as will potentially harmful radial expansion or collapsing of the bellows. Given the harsh conditions to which they will be exposed, however, protective seals still are susceptible to failure.

The statements in this section are intended to provide background information related to the invention disclosed and claimed herein. Such information may or may not constitute prior art. It will be appreciated from the foregoing, however, that there remains a need for new and improved gas injection and other gas control valves, and for new and improved gas lift systems to enhance production from oil and gas wells. For example, there is a continuing need for bellows-type valves that provide enhanced protection for the bellows, that have reduced risk of failure, and that have increased service life. Such disadvantages and others inherent in the prior art are addressed by various aspects and embodiments of the subject invention.

SUMMARY OF THE INVENTION

The subject invention relates generally to downhole valves for injecting gas into liquid production streams in oil and gas wells and other downhole gas control valves and to systems for assisting production from oil and gas wells by gas injection. It encompasses various embodiments and aspects, some of which are specifically described and illustrated herein.

One broad embodiment of the invention provides for a downhole valve for controlling flow of gas through a gas lift system for producing liquids from an oil and gas well. The downhole gas control valve comprises a valve housing, a fluid flowpath, a bellows, a sealed chamber, a valve stem, a valve body, a valve seat, and upper seal body, and a lower seal body. The valve housing has an inlet and an outlet. The fluid flowpath extends from the inlet to the outlet. The bellows is mounted within the housing and has an exterior and an interior. The sealed chamber is on the exterior of the bellows and is adapted to be filled with a liquid and a compressed gas. The liquid fills a lower portion of the sealed chamber extending around the exterior of the bellows and the gas fills an upper portion of the sealed chamber. The valve stem extends through the interior of the bellows and is mounted for axial reciprocation in the valve housing. The valve body is on a lower end of the valve stem. The valve seat is in the flowpath.

The exterior of the bellows is exposed to fluid pressure in the sealed chamber and the interior of the bellows is exposed to ambient fluid pressure. The bellows is adapted to collapse linearly when sealed chamber fluid pressure on its exterior is effectively greater 9 than ambient pressure on its interior and is adapted to expand linearly when the ambient fluid pressure on its interior is effectively greater than the sealed chamber fluid pressure on its exterior. The valve stem is coupled to the bellows and reciprocates as the bellows collapses and expands to move between a closed position and an open position. In the closed position the valve body is seated on the valve seat and the valve is placed in a closed state. In the open position the valve body is lifted off the valve seat and the valve is placed in an open state. The upper seal body is adapted to provide, in response to expansion of the bellows, an upper seal to isolate liquid in the lower portion of the sealed chamber from fluid pressure in the upper portion of the sealed chamber, the isolated liquid providing a liquid plug on the exterior of the bellows. The lower seal body is adapted to provide, in response to expansion of the bellows, a lower seal isolating the interior of the bellows from ambient fluid pressure.

Other embodiments provide such valves where the valve comprises a stem stop adapted to limit upward movement of the valve stem when the valve is in its open state.

Still other embodiments provide such valves where the lower seal body is mounted on the housing and the valve stem comprises a seat for the lower seal body.

Additional embodiments provide such valves where the lower seal body is an elastomer wedge seal having a downward-facing, truncated conical seal surface and is mounted on the housing, and the valve stem comprises an enlarged diameter portion having an upward-facing, truncated conical seat for the lower seal body.

Yet other embodiments provide such valves where the lower seal body is composed of a fluoroelastomer or a fluoroelastomer with a mineral filler.

Additional embodiments provide such valves where the upper seal body is mounted on the valve stem and the stem stop comprises a seat for the upper seal body.

Other embodiments provide such valves where the valve housing comprises a plurality of housing subs assembled by threaded connections.

Still other embodiments provide such valves where the housing has a fill port communicating with the sealed chamber.

Additional embodiments provide such valves where the valve comprises a plug threaded into the fill port.

Yet other embodiments provide such valves where a check valve is mounted in the fill port.

Further embodiments provide such valves where the valve seat is provided on a valve seat insert.

Other embodiments provide such valves where the valve seat insert is held in place by a retaining ring.

Still other embodiments provide such valves where the valve stem comprises a plurality of stem subs.

Additional embodiments provide such valves where the valve body is integral with the valve stem.

Yet other embodiments provide such valves where the valve body is a separate component carried at the end of the valve stem.

Other embodiments provide such valves where the stem stop is mounted in the housing for axial movement.

Still other embodiments provide such valves where the upper seal body provides the upper seal before the lower seal body provides the lower seal.

Additional embodiments provide such valves where the lower seal body provides the lower seal in response to fluid pressure on the interior of the bellows and compression of dissolved gas in the liquid plug in the lower portion of the sealed chamber.

Yet other embodiments provide such valves where the lower seal body is proximate to and establishes clearance from a lower seal seat when the upper seal body engages an upper seal seat to establish the upper seal, clearance between the lower seal body and the lower seal seat allows fluid pressure to increase in the interior of the bellows, and the bellows is adapted to expand further in response to the increase in fluid pressure in its interior and to compression of dissolved gas in the liquid plug in the lower portion of the sealed chamber. The valve stem is adapted to move upward in response to the further expansion of the bellows to seat the lower seal on the lower seal seat and to provide the lower seal.

Further embodiments provide such valves where the upper seal body is an elastomer wedge seal.

Other embodiments provide such valves where both the upper seal body and the lower seal body are elastomer wedge seals.

Still other embodiments provide such valves where the upper seal body is an elastomer wedge seal having an upward-facing, truncated conical seal surface and is mounted on the valve stem, and the stem stop comprises a downward-facing, truncated conical seat for the upper seal body.

Additional embodiments provide such valves where the stem stop comprises a passage extending axially through the stem stop, and a lower portion of reduced outer diameter extending into a bottomed, axial hole in an upper portion of the valve stem. The reduced outer diameter portion of the stem stop and the passage in the upper portion of the valve stem are sized to provide clearance to allow fluid flow therebetween when the valve is in its closed state.

Yet other embodiments provide such valves where the valve comprises a stem stop assembly. The stem stop assembly comprises the stem stop, a retainer, and a resilient member. The stem stop is mounted in the housing for axial movement. The retainer is mounted in the housing above the stem stop. The resilient member is mounted between the stem stop and the retainer. The resilient member biases the stem stop downward.

Further embodiments provide such valves where the retainer has a passage allowing fluid flow therethrough.

Other embodiments provide such valves where the retainer comprises a standard hex socket nut and a jam hex socket nut or where the retainer is adapted to adjust the sequence and timing of the setting of said upper seal and lower seal.

Still other embodiments provide such valves where the valve stem comprises a first component coupled to a second component. The coupling allows the first and second components to move axially relative to each other.

Additional embodiments provide such valves where the first component is a stem cap attached to the upper end of the bellows and the second component is a stem sub. The coupling comprises a guide affixed to the stem sub, a retainer bolt extending through the guide and threaded into the stem cap, and a resilient member extending between the guide and a head on the retainer bolt.

Yet other embodiments provide such valves where the stem stop is integral to the housing.

Further embodiments provide such valves where the lower seal body provides the lower seal before the upper seal body provides the upper seal.

Other embodiments provide such valves where the upper seal body provides the upper seal in response to fluid leaking through the lower seal.

Still other embodiments provide such valves where the upper seal body is proximate to and has clearance from an upper seal seat when the lower seal body engages a lower seal seat to establish the lower seal. The bellows is adapted to expand further in response to fluid leaking through the lower seal and a resulting increase in fluid pressure on its interior side. The valve stem is adapted to move upward in response to the further expansion of the bellows to seat the upper seal body on the upper seal seat to provide the upper seal.

Additional embodiments provide such valves where the lower seal body is an elastomeric wedge seal having a downward-facing, truncated conical seal surface and the upper seal body is an elastomeric O-ring.

Yet other embodiments provide such valves where the valve stem comprises a stem cap assembly. The stem cap assembly comprises a stem cap, a guide insert coupled to the valve stem below the stem cap, a retainer extending through the insert and engaging the stem cap, and a resilient member mounted between the insert and the retainer such that the stem cap is biased downward.

In other aspects and embodiments, the invention provides for downhole valves for controlling flow of gas through a gas lift system for producing liquids from an oil and gas well. The downhole gas control valve comprises a valve housing, a fluid flowpath, a bellows, a sealed chamber, a valve stem, a valve body, a vale seat, an upper seal body, and a lower seal body. The valve housing has an inlet and an outlet. The fluid flowpath extends from the inlet to the outlet. The bellows is mounted within the housing and has an exterior and an interior. The sealed chamber is on the interior of the bellows and is adapted to be filled with a liquid and a compressed gas. The liquid fills a lower portion of the sealed chamber extending into the interior of the bellows and the gas fills an upper portion of the sealed chamber. The valve stem extends through the interior of the bellows and is mounted for axial reciprocation in the valve housing. The valve body is on a lower end of the valve stem. The valve seat is in the flowpath.

The interior of the bellows is exposed to fluid pressure in the sealed chamber and the exterior of the bellows is exposed to ambient fluid pressure. The bellows is adapted to expand linearly when sealed chamber fluid pressure on its interior is effectively greater 13 than ambient pressure on its exterior and is adapted to collapse linearly when the ambient fluid pressure on its exterior is effectively greater than the sealed chamber fluid pressure on its interior. The valve stem is coupled to the bellows and reciprocates as the bellows expands and collapses to move between a closed position, in which closed position the valve body is seated on the valve seat and the valve is placed in a closed state, and an open position, in which open position the valve body is lifted off the valve seat and the valve is places in an open state. The upper seal body is adapted to provide, in response to collapsing of the bellows, an upper seal to isolate liquid in the lower portion of the sealed chamber from fluid pressure in the upper portion of the sealed chamber, the isolated liquid providing a liquid plug on the interior of the bellows. The lower seal body is adapted to provide, in response to collapsing of the bellows, a lower seal isolating the exterior of the bellows from ambient fluid pressure.

Other embodiments provide such valves where the valve comprises a stem stop adapted to limit upward movement of the valve stem when the valve is in its open state.

Still other embodiments provide such valves where the lower seal body is mounted on the housing and the valve stem comprises a seat for the lower seal body.

Additional embodiments provide such valves where the lower seal body is an elastomer wedge seal having a downward-facing, truncated conical seal surface and is mounted on the housing, and the valve stem comprises an enlarged diameter portion having an upward-facing, truncated conical seat for the lower seal body.

Yet other embodiments provide such valves where the lower seal body is composed of a fluoroelastomer or a fluoroelastomer with a mineral filler.

Additional embodiments provide such valves where the upper seal body is mounted on the stem stop and the valve stem comprises a seat for the upper seal body.

Further embodiments provide such valves where the upper seal body is mounted on the valve stem and the stem stop comprises a seat for the upper seal body.

Other embodiments provide such valves where the stem stop is mounted in the housing for axial movement.

Still other embodiments provide such valves where the upper seal body provides the upper seal before the lower seal body provides the lower seal.

Additional embodiments provide such valves where the lower seal body provides the lower seal in response to fluid pressure on the exterior of the bellows and compression 14 of dissolved gas in the liquid plug in the lower portion of the sealed chamber.

Yet other embodiments provide such valves where the lower seal body is proximate to and establishes clearance from a lower seal seat when the upper seal body engages an upper seal seat to establish the upper seal, and clearance between the lower seal body and the lower seal seat allows fluid pressure to increase on the exterior of the bellows. The bellows is adapted to collapse further in response to the increase in fluid pressure on its exterior and to compression of dissolved gas in the liquid plug in the lower portion of the sealed chamber. The valve stem is adapted to move upward in response to the further collapsing of the bellows to seat the lower seal on the lower seal seat and to provide the lower seal.

Further embodiments provide such valves where the upper seal body is an elastomer wedge seal.

Other embodiments provide such valves where both the upper seal body and the lower seal body are elastomer wedge seals.

Still other embodiments provide such valves where the upper seal body is an elastomer wedge seal having a downward-facing, truncated conical seal surface and is mounted on the stem stop, and the valve stem comprises an upward-facing, truncated conical seat for the upper seal body.

Additional embodiments provide such valves where the stem stop comprises a passage extending axially through the stem stop adapted to allow fluid flow between the upper portion of the sealed chamber and the lower portion of the sealed chamber.

Yet other embodiments provide such valves where the valve comprises a stem stop assembly. The stem stop assembly comprises a stem stop, a retainer, and a resilient member. The stem stop is mounted in the housing for axial movement and the upper seal body is mounted on the stem stop. The retainer is mounted in the housing above the stem stop. The resilient member mounted between the stem stop and the retainer, the resilient member biasing the stem stop downward.

Further embodiments provide such valves where the retainer has a passage allowing fluid flow therethrough.

Other embodiments provide such valves where the retainer comprises a standard hex socket nut and a jam hex socket nut or where the retainer is adapted to adjust the sequence and timing of the setting of said upper seal and lower seal.

Addition embodiments of the novel valves will have various combinations of such features as will be apparent to workers in the art.

In other aspects and embodiments, the invention provides for gas lift systems for producing liquids from a well. The gas lift system comprises production tubing adapted to convey fluid from the well to the surface and a plurality of the novel gas injection valves installed on the production tubing and adapted to control the flow of gas between an annulus surrounding the production tubing and the production tubing.

Finally, still other aspects and embodiments of the invention will have various combinations of such features as will be apparent to workers in the art.

Thus, the present invention in its various aspects and embodiments comprises a combination of features and characteristics that are directed to overcoming various shortcomings of the prior art. The various features and characteristics described above, as well as other features and characteristics, will be readily apparent to those skilled in the art upon reading the following detailed description of the preferred embodiments and by reference to the appended drawings.

Since the description and drawings that follow are directed to particular embodiments, however, they shall not be understood as limiting the scope of the invention. 2 They are included to provide a better understanding of the invention and the way it may be 3 practiced. The subject invention encompasses other embodiments consistent with the claims set forth herein.

Figure 1:
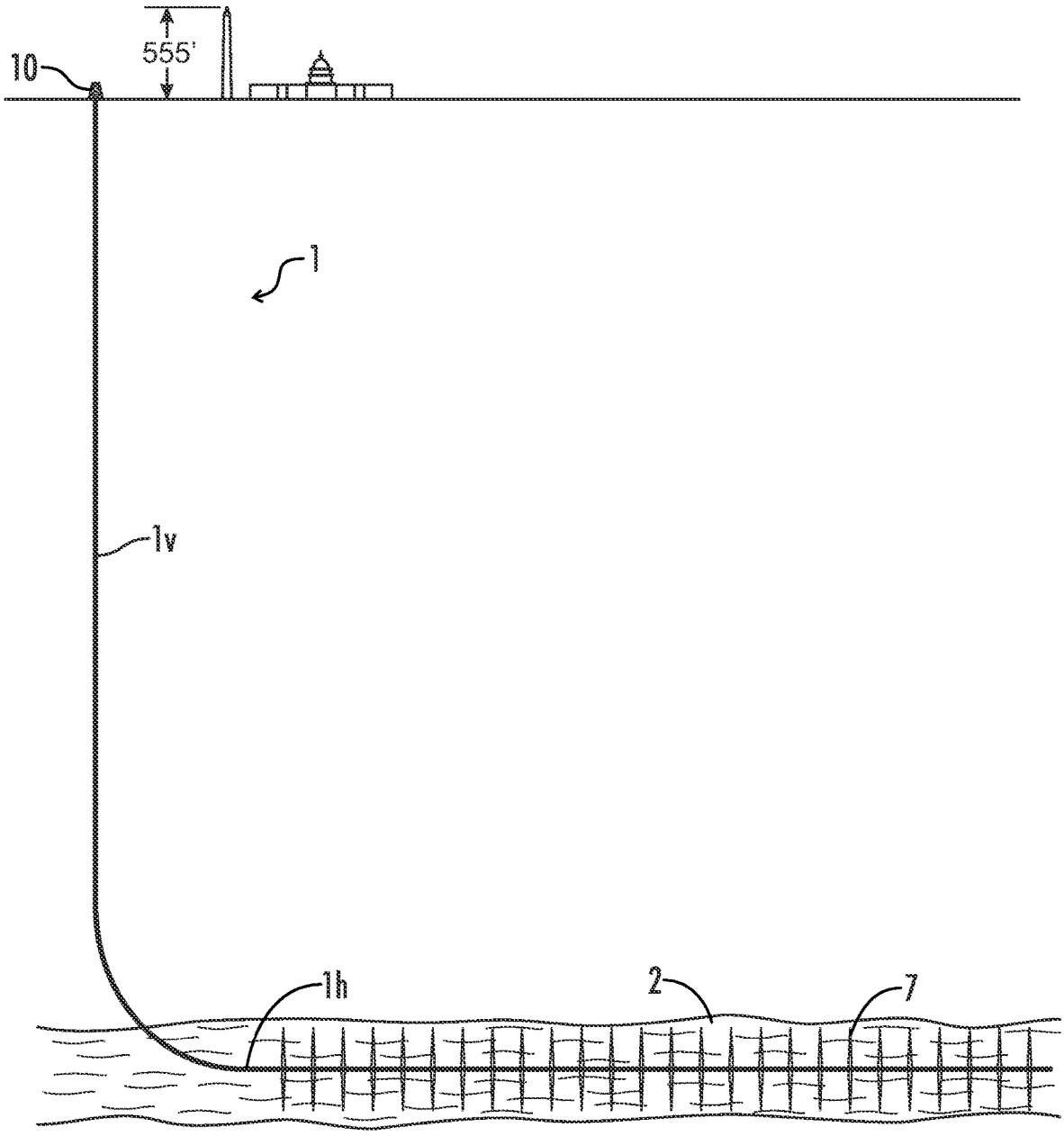
FIG. 1 (prior art) is a schematic depiction in approximate scale of an oil and gas well 1 having a horizontal extension 1*h*.

In the drawings and description that follows, like parts are identified by the same reference numerals. The drawing figures are not necessarily to scale. Certain features of the embodiments may be shown in exaggerated scale or in somewhat schematic form and some details of conventional design and construction may not be shown in the interest of clarity and conciseness.

DESCRIPTION OF ILLUSTRATIVE EMBODIMENTS

The subject invention relates generally to downhole gas control valves and gas lift systems for enhancing the flow of oil and other liquids from wells. Some of the embodiments are described in detail herein. For the sake of conciseness, however, all features of an actual implementation may not be described or illustrated. In developing any actual implementation, as in any engineering or design project, numerous implementation-specific decisions must be made to achieve a developers' specific goals. Decisions usually will be made consistent within system-related and business-related constraints, and specific goals may vary from one implementation to another. Development efforts might be complex and time consuming and may involve many aspects of design, fabrication, and manufacture. Nevertheless, it should be appreciated that such development projects would be a routine effort for those of ordinary skill having the benefit of this disclosure.

The terms "upper" and "lower" and "uphole" and "downhole" as used herein to describe location or orientation are relative to the well. Thus, "upper" and "uphole" refers to a location or orientation toward the upper or surface end of the well. "Lower" or "downhole" is relative to the lower end or bottom of the well. It also will be appreciated that the course of the wellbore may not necessarily be as depicted schematically in FIG. 1. Depending on the location and orientation of the hydrocarbon bearing formation to be accessed, the course of the wellbore may be more or less deviated in any number of directions.

"Axial," "radial," "angularly," and forms thereof reference the primary axis of the novel gas control valves, that is the central axis extending the length of the valve. For example, axial movement or position refers to movement or position generally along or parallel to the primary axis. "Lateral" movement and the like also generally refer to up and down movement or positions up and down the primary axis. "Radial" will refer to positions or movement toward or away from the primary axis.

Overview of Well Completion Operations

The complexity and challenges of completing and producing a well perhaps May be appreciated by reference to FIG. 1. FIG. 1 shows a well 1 approximately to scale. Well 1 includes a vertical portion 1*v* and a horizontal portion 1*h*. Schematic representations of the Washington Monument, which is 555 feet tall, and the Capital Building are shown next to a derrick 10 to provide perspective. Well 1 has a vertical depth of approximately 6,000 feet and a horizontal reach of approximately 6,000 feet. Such wells are typical of wells in the Permian Basin. Deeper and longer wells, however, are constructed both in the Permian and elsewhere. While neither the vertical portion 1*v* nor the horizontal portion 1*h* of well 1 necessarily run true to vertical or horizontal, FIG. 1 provides a general sense of what is involved in oil and gas production. Well 1 is targeting a relatively narrow hydrocarbon-bearing formation 2, and all downhole equipment must be installed and operated far away from the surface.

Figure 2:
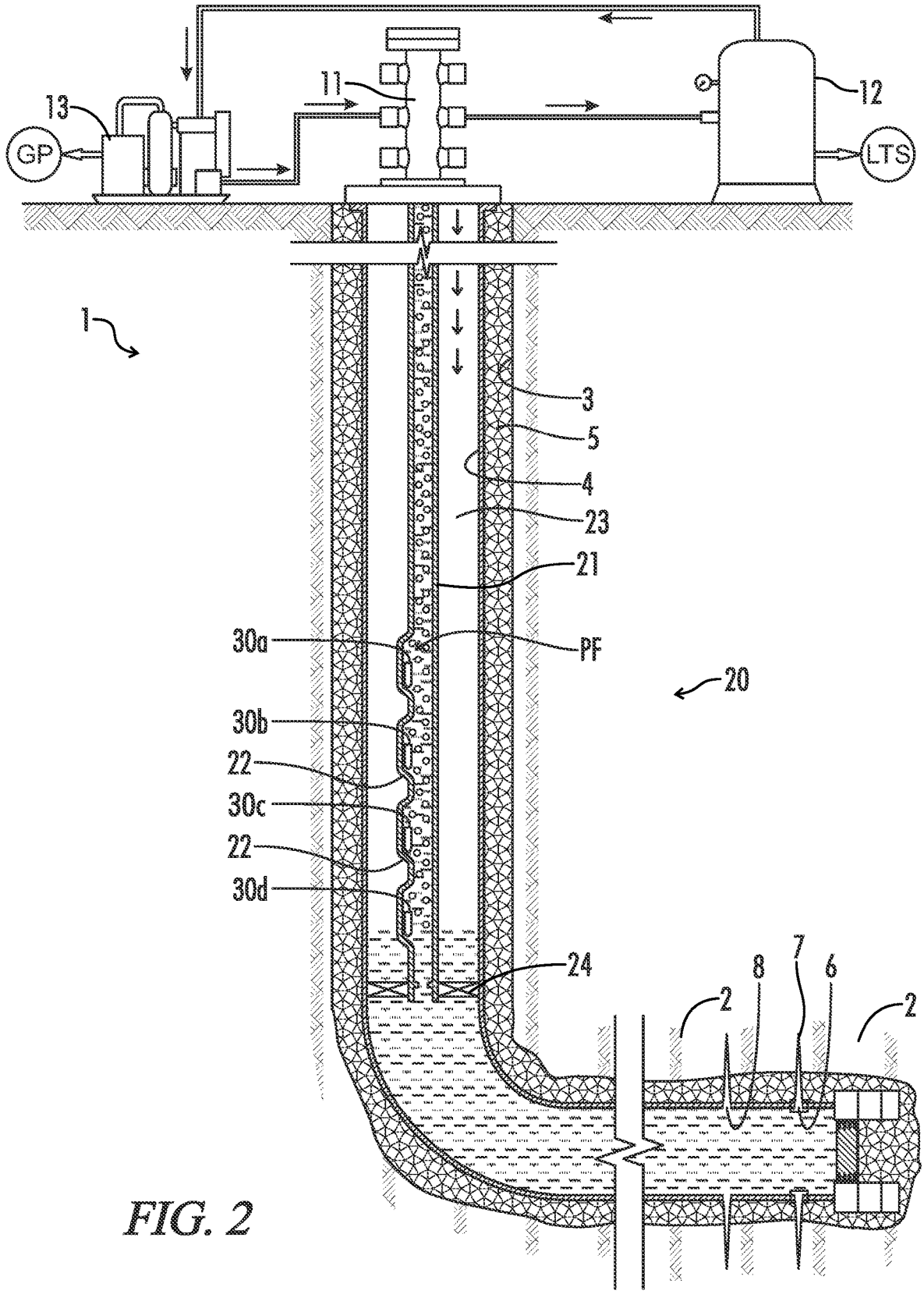
FIG. 2 is a schematic illustration showing well 1 after components of a first embodiment 20 of the novel gas lift systems have been installed in a production casing 4.

FIG. 2 shows well 1 after a first embodiment 20 of the novel gas lift production systems has been installed. A wellbore 3 has been drilled through formation 2 and a production casing 4 has been sealed within wellbore 3 with a sheath of cement 5. Various tools are assembled into casing 4, including a toe valve 6. Toe valve 6 was opened and fluid pumped into formation 2 at high pressure and flow rates to create fractures 7 in a first zone near the "toe" of well 1.

A "plug and perf" job then was performed on well 1. That is, a first plug was installed above toe valve 6, and first perforations 8 were created in casing 4 above the plug using a "perf" gun. Fluid then was pumped into casing 4 to fracture formation 2 in a second zone near perforations 8. Another plug then was installed above the first plug, additional perforations 8 were formed above the second plug, and formation 2 was fractured in a third zone. The process was repeated until fractures 7 were created along the length of horizontal extension 1*h* as shown in FIG. 1.

The frac plugs then were removed from casing 4, usually by drilling them out. After completion of the plug and perf job, hydrostatic pressure in formation 2 was sufficient to push production fluids PF through casing 4 all the way to the surface. Flow of production fluids PF out of casing 4 are controlled by a wellhead 11. Production fluids PF, as exemplified herein, are predominantly oil, a liquid, but also contain entrained natural gas. Thus, wellhead 11 diverts production fluids PF into an oil-gas separator 12. Separator 12, as its name implies, separates the liquid and gas components of the stream of production fluids PF. Gas is diverted into a gas pipeline GP, while oil and other liquids are diverted into a liquid transportation system LTS.

It will be appreciated that both the subsurface and surface systems and the methods referenced above have been greatly simplified. A production casing, for example, May incorporate many different tools to assist in installing and cementing the casing. Moreover, solid particulates typically are entrained with the oil and other liquids produced from the well, especially in the initial production stream. Liquid typically will be diverted from an oil-gas separator into a sand separator. Although the liquid production fluids hopefully are predominantly oil, typically they include at least some water. Thus, liquid production fluids typically will be diverted into a water separator. Produced oil may be transferred to a storage tank for transport to a pipeline, or it may feed directly into a pipeline. Gas streams may be run through dryers and filters designed to remove moisture and particulates that can corrode gas pipelines. Perforating casing 4 and fracturing formation 2, as appreciated by workers in the art, also requires other operations not mentioned herein.

In general, as shown schematically in FIG. 2, gas lift system 20 comprises a production tube 21 and a series of first embodiments 30 of the novel downhole gas injection valves. The operation of novel gas lift system 20 will be described further below, but as may be seen in FIG. 2, production tube 21 extends through a packer 24 near the "heel" of well 1. Packer 24 provides a seal between production tube 21 and casing 4, thus diverting production fluids PF from casing 4 into production tube 21. Production tube 21 may be any conventional tubing, such as coiled tubing. Preferably, however, production tube 21 will be assembled from joints of pipe. The joints may be of larger diameter than coiled tubing and thus provide greater production capacity.

Valves 30, as shown schematically in FIG. 2, are installed along production tube 21 at various depths in well 1. They may be installed outside production tube 21 on special joints or mandrels. The mandrels are provided with passages that allow valves 30 to communicate with the interior of production tube 21. Preferably, however, production tube includes pocket mandrels, such as pocket mandrels 22. Pocket mandrels 22 provide a volume to the side of the main cross-section or "drift" of production tube 21. A receptacle is provided in that volume to allow valves 30 to be installed, removed, and replaced through production tube 21. The receptacles have various passages that allow valves 30 to communicate with annulus 23 and production tube 21.

When production tube 21 is initially installed hydrostatic pressure in formation 2 typically still will be high enough to push liquid PF all the way to the surface. Gas injection valves 30 will not be needed as long as liquid PF flows naturally to the surface. Nevertheless, many well operators will prefer to install gas injection valves 30 relatively early, more or less at the same time that production tube 21 is installed. Well operators often view that as more cost effective than running a special job later just to install valves 30. The cost of readying a well for production is substantial, in terms of both the heavy equipment and the labor required on site. Installing as many of the downhole tools as possible at the same time may mean fewer well operations and lower costs overall.

If desired, however, installation of valves 30 in production tube 21 may be delayed until liquid PF no longer is able to reach the surface. Dummy valves (not shown) may be installed in production tube 21 until valves 30 are required for lift operations. Dummy valves are essentially plugs that shut the passages in the receptacles in pocket mandrels 22 and prevent fluids from flowing between production tube 21 and annulus 23. Dummy valves also can help reduce the accumulation of debris in the valve receptacles that otherwise might interfere with installation or operation of functional gas lift valves 30 when they are needed. Surface equipment required for various stages of artificial lift also need not be installed until liquid PF no longer flows unassisted to the surface.

Overview of Gas Lift Operations

As illustrated in FIG. 1, well 1 may extend thousands of feet into the earth. The hydrostatic head, that is the weight of fluid PF in production tube 21, will be quite large. After a period of time, the bottom bole pressure behind liquid PF at the bottom of well 1 will no longer exceed the hydrostatic head in production tube 21. Oil cannot flow naturally to the surface. Thus, FIG. 2 shows gas lift system 20 being used to produce liquid PF from well 1 by continuous gas lift.

Novel gas injection valves 30 have been installed in pocket mandrels 22 of production tube 21. A field compressor 13 has been installed at the surface. A portion of the gas produced from well 1 is diverted from the oil-gas separator 12 into field compressor 13. The diverted gas is compressed by compressor 13, typically to pressures of about 1,000 to 1,200 psi, and less commonly up to perhaps 2,500 psi. A portion of the compressed gas will be pumped through wellhead 11 into annulus 23 between production tube 21 and 13 casing 4. Gas pumped into annulus 23, as described further below, will selectively shut 14 gas injection valves 30 to assist in the flow of liquid PF up production tube 21.

The ultimate objective of continuous lift systems is to inject sufficient gas into production tube 21 to reduce the pressure head of production fluids PF in production tube 21 to a point where the formation pressure is able to push liquid PF to the surface. Though not initially, eventually that will entail injecting gas through an operating injection valve at a single station located as deep as possible in the vertical portion 1*v* of well 1. That way the entire stream of production fluids PF flowing up production tube 21 may be lightened by injected gas. The liquid in annulus 23 between casing 4 and production tube 21, however, must be pushed out of annulus 23, that is, unloaded before continuous gas lift operations can be initiated. In shallower wells and under certain conditions it may be possible to unload annulus 23 and inject gas through a single operating valve 30. Injection pressures produced by the most common surface compressors may be sufficient to unload all liquid in annulus 23 through the operating valve 30.

Most often, however, the well may be too deep to unload fluids efficiently and economically only through the operating valve. Pressures of 5,000 psi or more may be required. For example, pressures of approximately 4,000 psi may be required when the operating valve is at 10,000 ft. The acquisition and operating cost of compressors required to produce those high injection pressures may make unloading only through the operating valve impractical. The compressors also may have power requirements and capacities far greater than required once the annulus has been unloaded. Gas supply also may be limited, or the fluids in the production tube may be particularly dense. Thus, it usually is necessary to utilize multiple unloading valves installed at progressively deeper stations above the operating valve to unload the annulus efficiently and economically.

For example, as shown schematically in FIG. 2, valves 30 in gas lift system 20 are installed at progressively deeper stations along production tube 21. They are described in detail below, but in general valves 30 are similar to conventional gas injection valves that incorporate pressure-responsive bellows. The bellows are exposed on one side to pressure in a sealed pressure chamber. The pressure in the sealed chamber, typically referred to as the valve's dome pressure, biases valves 30 towards its closed state. The other side of the bellows is exposed to fluid pressure in annulus 23. As pressure in annulus 23 varies relative to the dome pressure in the sealed chamber, the bellows expands and contracts accordingly, either opening the valve or allowing the valve to close.

Each valve 30*a*, 30*b*, 30*c*, and 30*d* will be individually tuned. That is, the dome pressure in the sealed chamber will be set according to the depth at which valve 30 will be installed. Each valve 30 will be charged such that the dome pressure allows it to open when it is installed at its specified depth in production tube 21. At the same time, as described further below, the differing dome pressures in valves 30 will allow them to successively close from the top down by successive reductions in gas pressure in annulus 23.

Upper valves 30*a*, 30*b*, and 30*c* will serve as unloading valves, while lowest valve 30*d* will provide the operating injection valve after annulus 23 has been unloaded. Lift system 20 is illustrated as having four stations, but the number of stations and valves 30 required will vary, most significantly with the depth of the well and the density of the production fluids. In any event, the stations are located at different depths, typically from about 500 to 1,000 feet apart. Uppermost valve 30*a* typically will be installed well below the surface, perhaps at 2,000 to 3,000 feet. The lowermost valve 30*d* will be installed relatively near the end of production tube 21 at depths of up to 10,000 feet or greater. When valves 30 are installed, production fluids PF fill both annulus 23 and production tube 21. Given the depth at which they are installed, the pressure head in production tube 21 will be well in excess of that required to open the normally-closed 3 valves 30. All valves 30 will be open allowing liquid to flow between annulus 23 and production tube 21. Unloading of liquids from annulus 23 is initiated by pumping gas into annulus 23 at controlled rates and pressures. As gas is pumped into annulus 23, liquid therein will be forced into production tube 21, at least initially, through all injection valves 30.

Initially, gas pressure in annulus 23, that is, the casing pressure increases steadily, generally linearly as the volume of liquid displaced into production tube 21 increases. As gas continues to be carefully metered into annulus 23, liquid is pushed down annulus 23, through injection valves 30, and up production tube 21. Casing pressure increases, reaching a peak or "kickoff" pressure just before the liquid level reaches the uppermost unloading gas injection valve 30*a*. When liquid level in annulus 23 drops below valve 30*a*, gas begins flowing through valve 30*a* into production tube 21. The casing pressure drops noticeably, confirming to surface controls and observers that gas in fact is flowing through valve 30*a*.

As unloading continues, gas continues to flow through injection valve 30*a*, reducing the density and, therefore, the weight of the column of oil PF in production tube 21. Liquid PF in production tube 21 is able to flow more readily to the surface. Liquid in annulus 23 continues to flow into production tube 21 through lower valves 30*b*, 30*c*, and 30*d*. The liquid level in annulus 23 continues dropping.

Eventually, the liquid level in annulus 23 drops below the next lower valve 30*b*. Gas then begins flowing through valve 30*b*. Casing pressure again drops noticeably, confirming that gas is flowing through valve 30*b*. With gas now flowing through both valve 30*a* and next-lower valve 30*b*, the continuing drop in casing pressure soon thereafter allows uppermost valve 30*a* to return to its normal, closed state. Lower valves 30*b*, 30*c*, 27 and 30*d* remain open.

The operation continues. Gas flows into production tube 21 through unloading valve 30*b* and liquid flows from annulus 23 into production tube 21 through valves 30*c* and 30*d*. Liquid levels in annulus 23 reach progressively deeper valves 30*c* and 30*d*, corresponding pressure drops are detected, and valves 30*b* and 30*c* are shut in succession until only the deepest operating valve 30*d* is open. Gas in annulus 23 then flows through injection valve 30*d* into liquid PF flowing up production tube 21. The density of liquid PF will be reduced, thus reducing the weight of the column of oil in production tube 21. Liquid PF now is able to continue flowing to the surface.

After an additional period of time, well 1 will be further depleted and its bottom hole pressure further diminished. More and more gas must be injected into production fluid PF to reduce its weight below the formation pressure. At a certain point, liquid PF will simply fall out of the injected gas and remain in production tube 21. Operators then often turn to intermittent gas lift to continue production from the well.

Unlike continuous lift, which injects a continuous, relatively low-volume flow of gas into a production stream, intermittent lift relies on the periodic, but rapid injection of relatively large volumes of gas. The well is "shut in," that is, flow through production tube is shut off by a valve in wellhead 11. Pumping of gas into annulus 23 is stopped and shut off. That allows pressure in formation 2 to build up and a slug of liquid to accumulate in the lower portion of production tube 21 and annulus 23. Gas no longer flows through operating valve 30*d*.

After the well has been shut in for a sufficient period of time, gas is again injected into annulus 23 to open operating valve 30*d* and allow gas to flow through it into production tube 21. The valve in wellhead 11 controlling flow out of production tube 21 is opened allowing gas in the upper portion of production tube 21 to evacuate rapidly. That creates a large bubble of gas under the liquid slug in production tube 21. As it expands, it lifts the slug of liquid PF above it toward the surface.

A production tube check valve (not shown) typically will be installed in production tube 21 to prevent oil from being pushed down into well 1 as gas is injected rapidly into production tube 21. Additional check valves may be installed further up production tube 21 in order to reduce the hydrostatic pressure on check valves lower down in production tube 21. Production tube 21, therefore, preferably comprises nipples to receive replaceable check valves as may be needed. The nipple is illustrated schematically in FIG. 2 as a small, internal constriction in production tube 21.

In the last stages of a well's production cycle, it may not be practical to continue intermittent gas lift. The well's bottom hole pressure will have dropped even more. Fallback of oil though the gas and the volume of gas required may rise to unacceptable levels. Thus, an operator may choose to use plunger-assisted gas lift or to install a gas pump (not shown) to produce the remaining oil in a well.

Conventional plunger systems may be used, as may conventional gas pumps. Many such systems are available commercially. Plunger systems typically involve the installation of additional surface equipment. Conventional gas pumps can be installed by removing the production tube along with the other downhole equipment needed for continuous and intermittent injection. Preferably, however, gas pumps as disclosed in applicant's U.S. Pat. No. 10,858,921 to Michael S. Juenke, Stephen W. Turk, and E. Lee Colley, III and U.S. Pat. No. 11,767,740 to Michael S. Juenke, Stephen W. Turk, and E. Lee Colley, III, will be utilized, and the novel gas lift systems will be incorporated into a life-of-the-well system as disclosed therein. The disclosure contained in those patent documents are incorporated herein in their entirety by this reference. In the event of conflict with the incorporated disclosure, unless arising from obvious error, the disclosure provided in this incorporating application shall control.

It will be appreciated that the schematic representation of gas lift system 20 has been simplified in many respects. A variety of control and safety valves, chokes, meters, and gauges may be incorporated into the surface equipment. Booster compressors and accumulators may be provided in the high-pressure gas supply system. Hydraulic systems may be provided to operate valves and other equipment. Controllers and other auxiliary equipment may be installed so that the system may be operated automatically, and data may be recorded and displayed. Likewise, the packers, tubing, and many other components of the illustrated systems typically will have various features that, for example, enable them to be installed or retrieved, but are not shown in the figures.

Similarly, it will be appreciated that the lift operations described are illustrative and simplified in certain respects as well. For example, once the formation pressure is no longer able to push liquids all the way to the surface, it likely still is able to push flow well up the production tube. Formation pressure will diminish gradually. Thus, the well May be unloaded over an extended period of time. An upper unloading valve may serve as a transient operating valve for some time, especially if the rate of decline in the formation pressure is very slow. It may be quite a while before it is necessary to unload the annulus to the level of the lowermost, ultimate operating valve.

It also will be appreciated that lowermost, operating valve 30*d* in lift system 20 will always be open. There rarely, if ever, will be a need to close valve 30*d* during gas lift operations. Thus, it simply may be a choke installed in production tube 21.

The novel systems in large part may be assembled from conventional equipment. Field compressor 13, for example, is typical of equipment commonly employed in pneumatic systems for oil and gas wells. They typically will incorporate meters, sensors, controllers, and other auxiliary components that enable them to be operated automatically. In general, however, the other downhole equipment may be of any conventional design and are available from a number of manufacturers. Suitable production check valves, for example, may include standing valves available from Peak Well Systems, E-3 series standing valves available from American Completion Tools, and A-2 Series standing valves sold by Schlumberger. Conventional nipples suitable for use in the novel systems also are available from a number of commercial manufactures, such as the E series seating nipples available from American Completion Tools, Houston, Texas, and the No-Go profile nipples available from Peak Well Systems, Bayswater, Western Australia, Australia. Pocket mandrels that may be suitable include the D and F series pocket mandrels from Dover Artificial Lift, The Woodlands, Texas.

Broad embodiments of the novel gas control valves are bellows-type valves that comprise an upper seal body that provides an upper seal and a lower seal body that provides a lower seal. The seals are set in response to expansion of the bellows. The upper seal will isolate a liquid plug around the exterior of the bellows from gas pressure in the valve's sealed chamber. The lower seal body isolates the interior of the bellows from ambient fluid pressure. Various embodiments incorporate designs that manage and coordinate the setting of the upper and lower seals to ensure that the seals are set more reliably.

Alternately, the bellows may be mounted such that the interior of the bellows is exposed to fluid pressure in the sealed chamber. The upper and lower seals will be set in response to collapsing of the bellows. The upper seal will isolate a liquid plug in the interior of the bellows from gas pressure in the valve's sealed chamber. The lower seal body isolates the exterior of the bellows from ambient fluid pressure.

First Preferred Downhole Gas Control Valve

For example, a first preferred embodiment 30 of the novel downhole gas control valves is shown in greater detail in FIGS. 3-7. Valve 30 is a gas injection valve. As May be seen therein, gas injection valve 30 generally comprises a housing 31, a bellows 32, a valve seat 33, a valve body 34, a valve stem assembly 35, a stem stop assembly 36, an upper seal body 37, and a lower seal body 38. Bellows 32 and valve body 34 are operationally connected through valve stem assembly 35, as described further below, such that injection valve 30 is normally closed by stored fluid pressure above bellows 32 and is opened by ambient fluid pressure below bellows 32.

Valve housing 31 provides the base on and in which the other valve components are assembled. As seen best in FIG. 3, it has a generally open, elongated cylindrical shape. As exemplified, housing 31 is approximately 1" in diameter and has a length of about 18". Other embodiments typically will be no more than 2" in diameter and 60" in length, but may have larger or smaller dimensions. It generally is preferable that the size be minimized while still allowing for the required flow rates and other operational requirements of the valve. That shape and those dimensions allow valve 30 to be run through and installed in production tube 21 easily while minimizing any constriction it may present once installed. The outer circumference of housing 31 is profiled, as is its inner circumference to allow the other valve components to be mounted on and in housing 31. As described further below, housing 31 also defines various fluid chambers and flow paths that allow valve 30 to operate.

Figure 3:
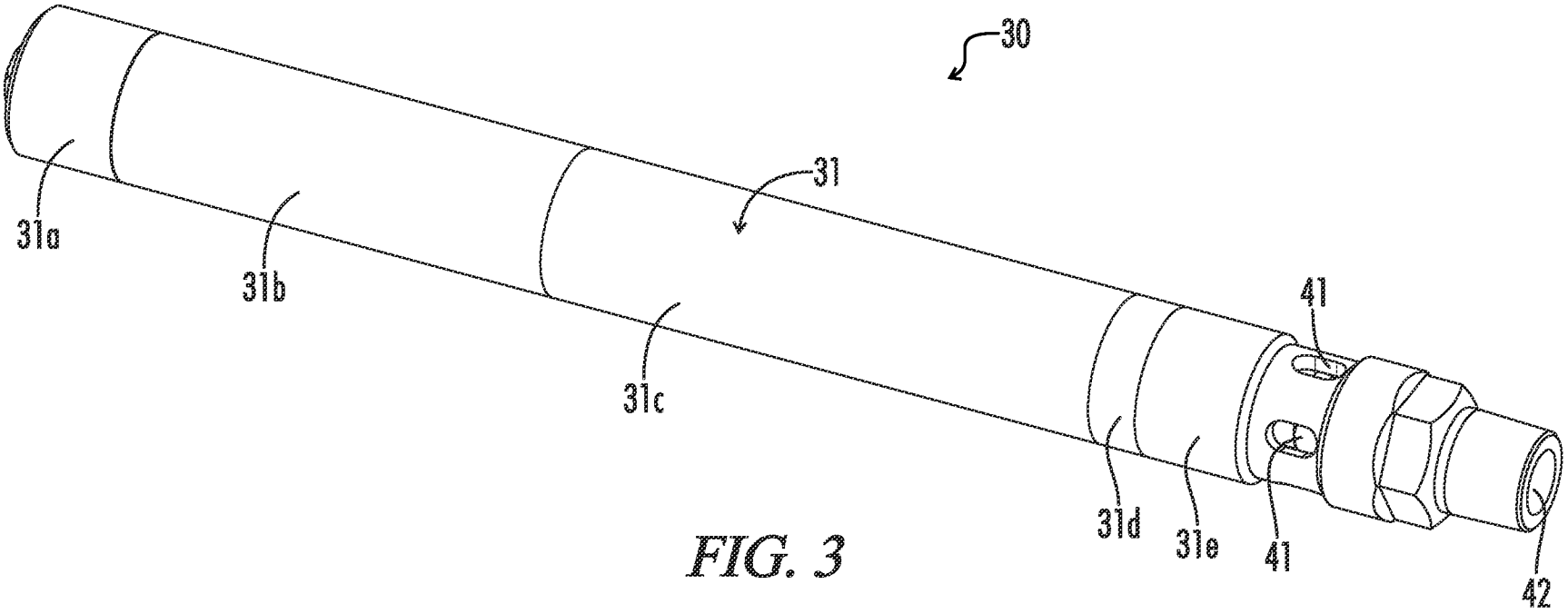
FIG. 3 is an isometric view of a first preferred embodiment 30 of the novel downhole gas injection valves of the subject invention which is used to inject gas into a production tube 21 of novel gas lift system 20 as shown schematically in FIG. 2.
Figure 4:
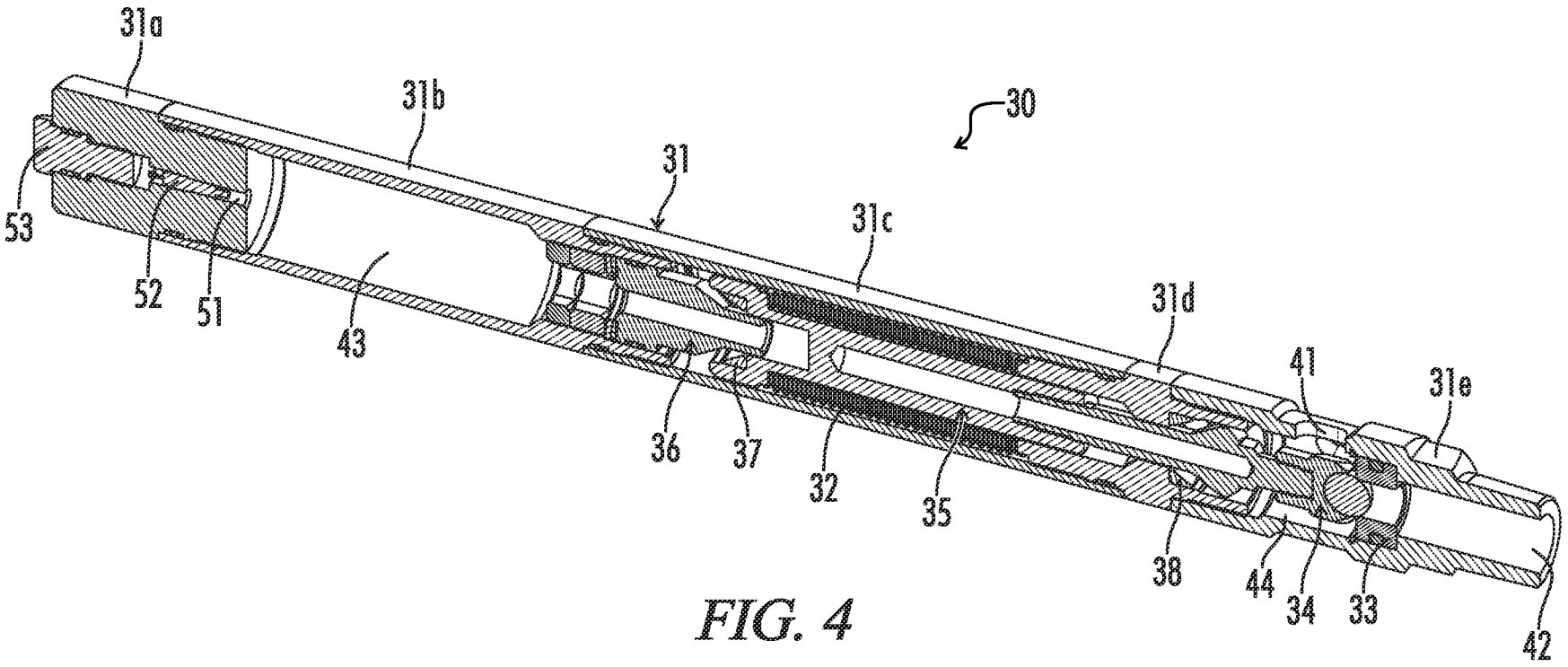
FIG. 4 is an isometric, cross-sectional view of gas injection valve 30 showing valve 30 in its normally closed state.
Figure 5A:
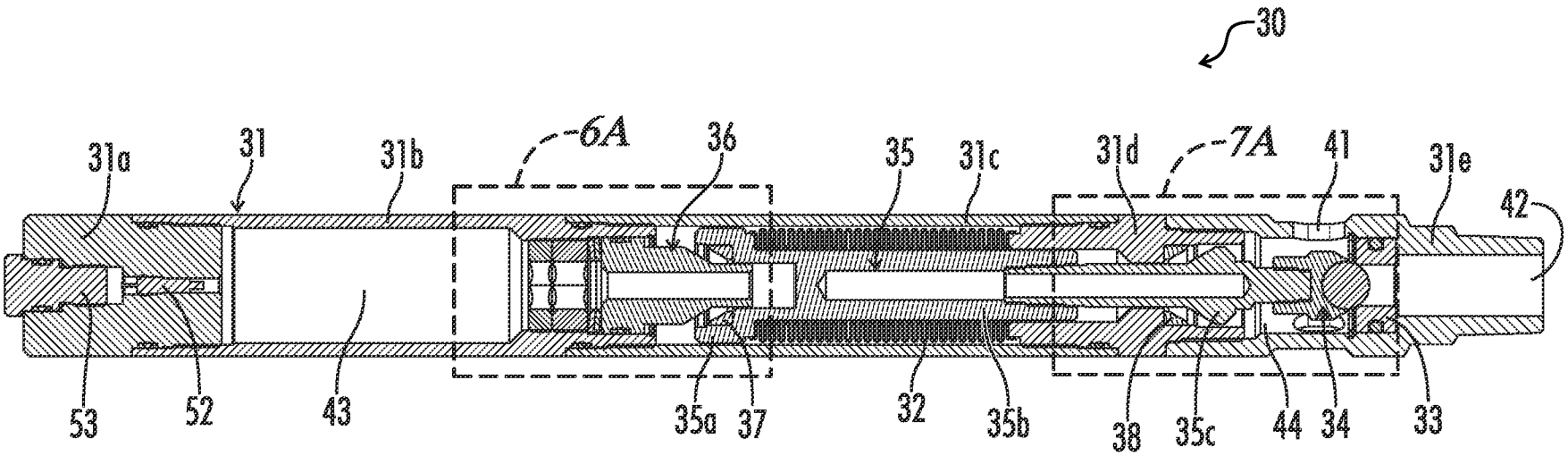
FIG. 5A is a longitudinal cross-sectional view of gas injection valve 30 showing valve 30 in its normally closed state.
Figure 5B:
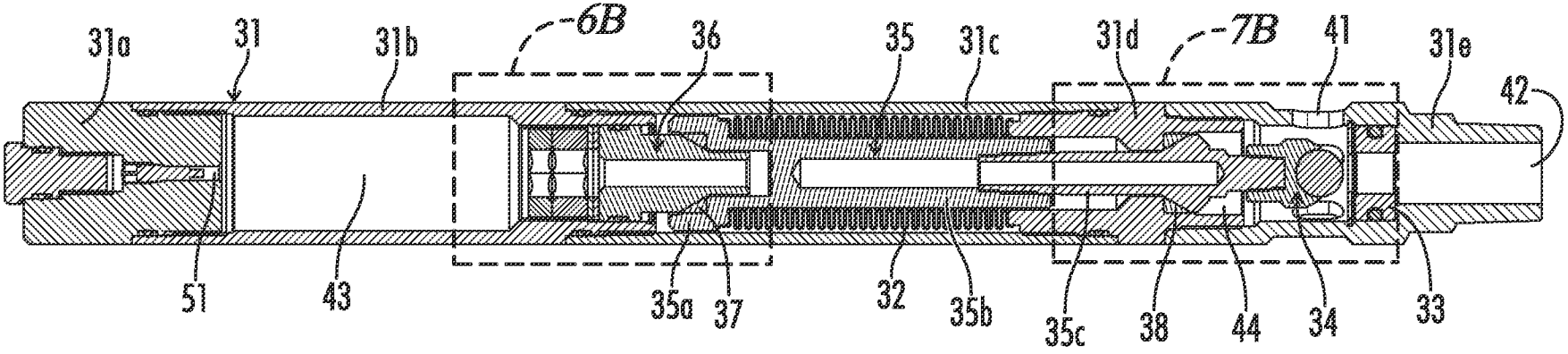
FIG. 5B is a longitudinal cross-sectional view of gas injection valve 30 showing valve 30 in its open state.

Preferably, as best appreciated in FIGS. 3-5, housing 31 is assembled from five subs 31*a* to 31*e*, sub 31*a* being the uppermost sub and sub 31*e* being the lowermost sub. Subs 31*a*-31*e* are joined together, for example, by threaded connections. Multiple housing subs simplify the manufacture of housing 31 and facilitate installation of the other valve 27 components. Housing 31 may be assembled from more or fewer subs, however, if desired.

Valve housing 31 and valve seat 33 provide a gas flow path through valve 30. More specifically, housing sub 31*e* is provided with inlet ports 41 extending radially through its wall. When valve body 34 is unseated from valve seat 33, gas can enter valve 30 through inlet ports 41, and then flow axially through valve seat 33 and out a gas outlet 42 provided in the lower portion of housing sub 31*e*. If desired, a choke (not shown) may be provided in the gas flow path, for example, below valve seat 33. The choke preferably will be removably mounted, for example, by threaded connections so that chokes of different sizes may be used with otherwise identical valves 30. The volume of gas flowing through valve 30, therefore, may be easily optimized for different flow pressures.

Bellows 32 applies a resilient force that biases valve 30 in a normally-closed state. It is mounted at its upper end to valve stem assembly 35 and at its lower end to the upper end of housing sub 31*d*. It extends closely within housing sub 31*c*. Bellows 32 thus divides 9 the space within housing 31 into two chambers: a sealed, upper chamber 43 and an open, lower chamber 44. Sealed, upper chamber 43 extends within housing sub 31*b* downward into housing sub 31*c* and around the exterior side of bellows 32. Open, lower chamber 44 extends on the interior side of bellows 32 downward within housing subs 31*d* and 31*e*.

Upper chamber 43 is filled partially with a liquid, such as silicon oil, petroleum-based fluids, or other noncorrosive hydraulic fluids, and a compressed gas, such as nitrogen gas. As discussed further below, the liquid in upper chamber 43, together with a seal established by upper seal body 37, will help protect bellows 32 from damage caused by excessive internal pressure. Upper chamber 43 also will be charged with gas to a specified dome pressure to tune valve 30 for deployment at a desired depth.

Fluids may be injected into upper chamber 43 through a port 51 in uppermost housing sub 31*a*. A check valve 52 in port 51 prevents injected fluids from escaping. Port 51 then is sealed shut by threaded plug 53. O-rings or other conventional seals are provided around plug 53. Caps with an integral check valve also are available and may be used if desired.

Valve inlet 41 and valve outlet 42 allow fluid communication between lower chamber 44 and the exterior of valve 30. In general, then, the exterior of bellows 32 is exposed to fluid pressure in sealed, upper chamber 43, and the interior of bellows 32 is exposed to ambient fluid pressure outside valve 30. It will enlarge or collapse in response to pressure differentials across upper chamber 43 and lower chamber 44. More precisely, given its pleated design, bellows 32 is designed to contract and expand axially, that is, it will decrease and increase in length. When the axial force on bellows 32 generated by the preset dome pressure in upper chamber 43, what will be referred to as the "effective" dome pressure in chamber 43, exceeds the "effective" ambient pressure in lower chamber 44, that is the axial force generated by ambient fluid pressure in lower chamber 44, bellows 32 will contract axially. It will expand axially when the effective pressure in lower chamber exceeds the preset effective dome pressure in upper chamber 43. As described further below, the contraction and expansion of bellows 32 will place valve in, respectively, a closed or an open state.

Valve stem assembly 35 extends axially through housing subs 31*c*, 31*d*, and 31*e* and is mounted therein for axial reciprocation. It generally comprises an upper stem sub 35*b* and a lower stem sub 35*c* assembled, for example, by threaded connections. As with the various subs used to assemble valve housing 31, providing a valve stem assembled from two subs can simplify manufacture and assembly of valve 30. Valve stem assembly 35, however, may be provided by a single component or assembled from a greater number of subs if desired.

Valve stem assembly 35 is attached toward its upper end to bellows 32. Valve body 34 is mounted to the lower end of valve stem 35. Thus, valve stem 35 will reciprocate axially as bellows 32 expands and contracts, lifting valve body 34 off, and seating valve body 34 on valve seat 33.

The upper portion of upper stem sub 35*b* is radially enlarged and provides an end cap 35*a* or base on which the upper end of bellows 32 is attached, for example, by welding. The lower portion of upper stem sub 35*b* is generally cylindrical and extends closely within bellows 32. It thus provides mechanical support against excessive pressure on the exterior of bellows 32. Lower stem sub 35*c* extends through housing subs 31*d* and 31*e* and the lower portion of lower chamber 44. As discussed further below, lower stem sub 35*c* also provides a seat for lower seal body 38.

Valve body 34 preferably, as shown, is a two-piece assembly comprising a capture 34*a* and a ball 34*b*. Capture 34*a* preferably is removably attached to lower stem sub 35*c* by, for example, a threaded connection. Ball 34*b* is adapted to seat upon and seal against valve seat 33. The lower face of capture 34*a*, therefore, is provided with a generally hemispherical recess into which ball 34*b* is mounted.

Valve seat 33 is a relatively short, generally open cylindrically shaped body or sleeve. It is mounted in housing sub 31*e* adjacent to the reduced diameter outlet 42. Preferably, as shown, it is removably mounted, for example, by a snap-ring retainer as shown or by a threaded connection. Seat seals, such as conventional elastomeric seals and packings, preferably are provided between valve seat 33 and housing sub 31*e*. The upper end of valve seat 33 is beveled to provide an upward-facing seal surface upon which ball 34*b* will bear.

Both valve body 34 and valve seat 33, therefore, may be easily replaced when worn. 9 If desired, however, valve stem assembly 35 may be provided with an integral valve body, and an integral valve seat may be provided, for example, in housing sub 31*e*. Likewise, the valve body and seat may have different, conventional geometries, notwithstanding that valve body 34 is exemplified herein as comprising a "ball."

Valve 30 thus can be placed in a closed state or an open state in response to the effective pressure differential across the exterior and interior of bellows 32. That is, when valve 30 is at the surface, after its dome pressure has been charged but before being installed in production tube 21, the effective dome pressure in upper chamber 43 will be substantially greater than the effective ambient pressure in lower chamber 44. Bellows 32 will contract axially, pushing valve stem assembly 35 downward and seating valve body 34 on valve seat 33. Valve 30 is in its closed state in which flow through the flow path between inlet 41 to outlet 42 is shut off.

When valve 30 is installed in production tube 21, however, the hydrostatic head of production fluids PF in annulus 23 will create ambient pressure in lower chamber 44 that is effectively greater than the effective dome pressure in upper chamber 43. Bellows 32 will expand axially, pulling valve stem assembly 35 upward and lifting valve body 34 off valve seat 33. Valve 30 is in its open state in which fluid is able to flow between inlet 41 and outlet 42.

Stem stop assembly 36 is adapted to limit upward movement of valve stem assembly 35 as it moves upward from its closed position, in which valve body 34 is seated on valve seat 33, toward its open position, in which valve body 34 has been lifted off valve seat 33. It generally comprises stem stop 61, Belleville washers 62, and lock nuts 63. Stem stop 61 is slidably mounted in housing sub 31*b*. It has a generally open cylindrical shape with a central, axial passage. The upper end of stem stop 61 has an enlarged external diameter portion that is slidably received within housing sub 31*b*. Seals, such as conventional elastomeric seals and packings, preferably are provided between the enlarged diameter portion of stem stop 61 and housing sub 31*b*.

Figure 6A:
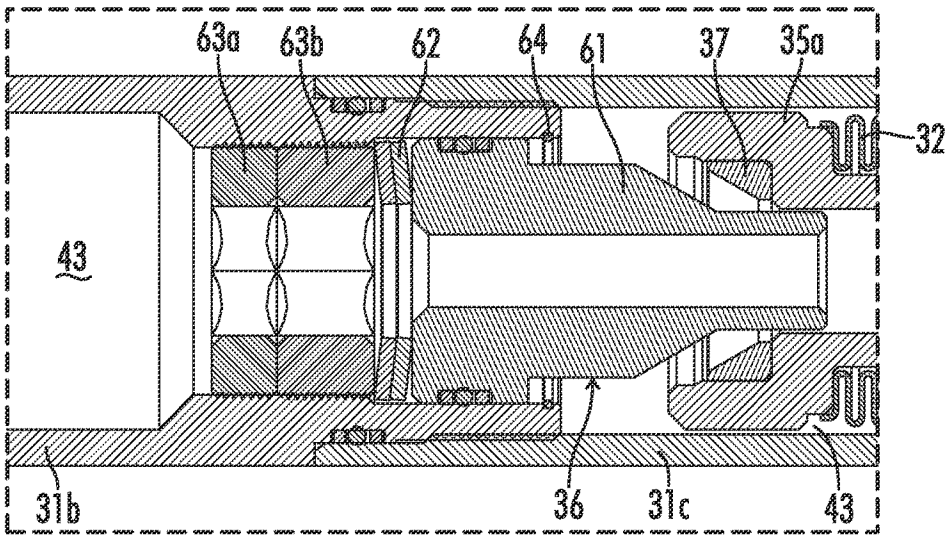
FIG. 6A is an enlarged view of portion 6A of FIG. 5A showing an upper seal body 37 with gas injection valve 30 in its closed state.

Stem stop 61 tapers downward into a lower, reduced external diameter portion, a nose if you will. The nose of stem stop 61 extends into a bottomed, axial hole in upper stem sub 35*b*. As best appreciated from FIGS. 6, the reduced outer diameter portion of the nose and the diameter of the bottomed axial hole are sized to provide clearance. The clearance allows fluid to flow through and around stem stop 61 when valve 30 is in its closed state as shown in FIGS. 5A and 6A. Fluid communication is established between the upper portion of upper chamber 43 and the lower portion of upper chamber 43 that extends around bellows 32.

Stem stop assembly 36 provides a soft stop for valve stem assembly 35. That is, stem stop 61 is mounted so that it can slide axially within housing 31 and resist to a limited degree upward movement after it is contacted by stem assembly 35. A soft, as opposed to a fixed, hard stop allows both upper seal body 37 and lower seal body 38 to set more reliably as described further below.

Figure 6B:
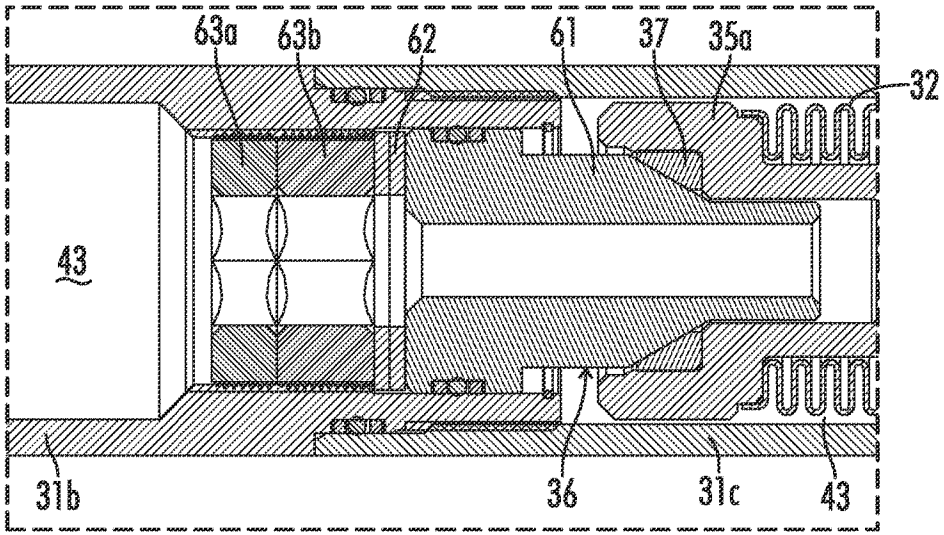
FIG. 6B is an enlarged view of portion 6B of FIG. 5B showing upper seal body with gas injection valve 30 in its open state.

For example, as seen best in FIGS. 6, a resilient member, such as Belleville washers 62, is sandwiched between stem stop 61 and an upper retainer, such as lock nuts 63. Belleville washers 62 resist upward movement by stem stop 61 once it has been contacted by valve stem assembly 35. Lock nuts 63 comprise a standard hex socket nut 63*b* and a jam hex socket nut 63*a*. They thus provide, together with a lower retainer, such as a split, snap ring 64 installed below stem stop 61, a simple and effective way to mount stem stop assembly within housing 31.

Lock nuts 63 also allow easy adjustment of the resistance provided by Belleville washers 62. Belleville washers 62 and lock nuts 63 also are annular components having a central opening, thus allowing fluid communication throughout upper chamber 43. Other retainers, however, may be used if desired, such as a fixed upper retainer and an adjustable lower retainer. Likewise, other resilient members may be used. A fixed stem stop mounted in housing 31 also may used, if desired, or a stem stop may be provided as an integral feature of housing 31 as exemplified below.

Upper seal body 37 and lower seal body 38 in novel valve 30 cooperate to provide bellows 32 with enhanced protection against damage caused by excessively high internal pressure. Sealed upper chamber 43, as noted above, is charged with both liquid and compressed gas. When installed in production tube 21, valve 30 will be oriented more or less vertically with its lower end pointed downhole. Liquid will collect in the lower portion of upper chamber 43, completely submerging bellows 32 and upper seal body 37.

Compressed gas remains in the upper portion of upper chamber 43. As bellows 32 expands and lifts valve body 34 off valve seat 33 to open valve 30, upper seal body 37 provides an upper seal. Liquid submerging the exterior of bellows 32 in the lower portion of sealed upper chamber 43 will be isolated from gas and liquid above seal body 37 that otherwise would allow further expansion of bellows 32. Lower seal body 38 provides a lower seal isolating the interior of bellows 32 from ambient fluid pressure that otherwise could further expand bellows 32.

Upper seal body 37 preferably, as seen best in FIGS. 6, is mounted on valve stem assembly 35. Stem stop 61 has a surface providing a seat for upper seal body 37. Upper seal body 37 is an annular elastomer seal. More precisely, it is a torus whose geometry results from rotation of an axially-aligned, right triangle off a central axis. Thus, upper seal body 37 provides a truncated conical sealing surface and may be referred to as a wedge seal.

End cap 35*a* of valve stem assembly 35 has an enlarged inner diameter relative to the lower portion of upper stem sub 35*b*. It thus provides an upward facing annular shoulder against which upper seal body 37 is mounted. As seen best in FIGS. 6, upper seal body 37 is mounted with its conically shaped sealing surface facing upward. The tapered, outer diameter portion leading into the nose of stem stop 61 provides a downward facing, truncated conical seat for upper seal body 37.

The angle of the sealing surface on upper seal body 37 (relative to the primary axis of valve 30) and the angle of the seal seat provided on stem stop 61 are coordinated to allow an effective seal to be set. Preferably, however, the angle of sealing surface on upper seal body 37 is somewhat greater than the angle of the seat provided by stem stop 61. That will create a squeegee effect and push liquid out of the seal area as the seal is established. It also will allow the seal set by upper seal body 37 to be broken more easily as ambient pressure drops and gas pressure in upper chamber 43 begins to urge valve stem assembly 35 downward toward its closed position. For example, the seat on stem stop 61 may be approximately 30° while the angle of the sealing surface on upper seal body 37 is approximately 45°. Other angles may be suitable. Likewise, while a wedge seal is preferred, upper seal body 37 may have other designs and geometries, such as an O-ring, and still provide an effective seal. Upper seal body 37, if desired, also may be mounted on stem stop 61 and a seat provided on valve stem assembly 35.

Figure 7A:
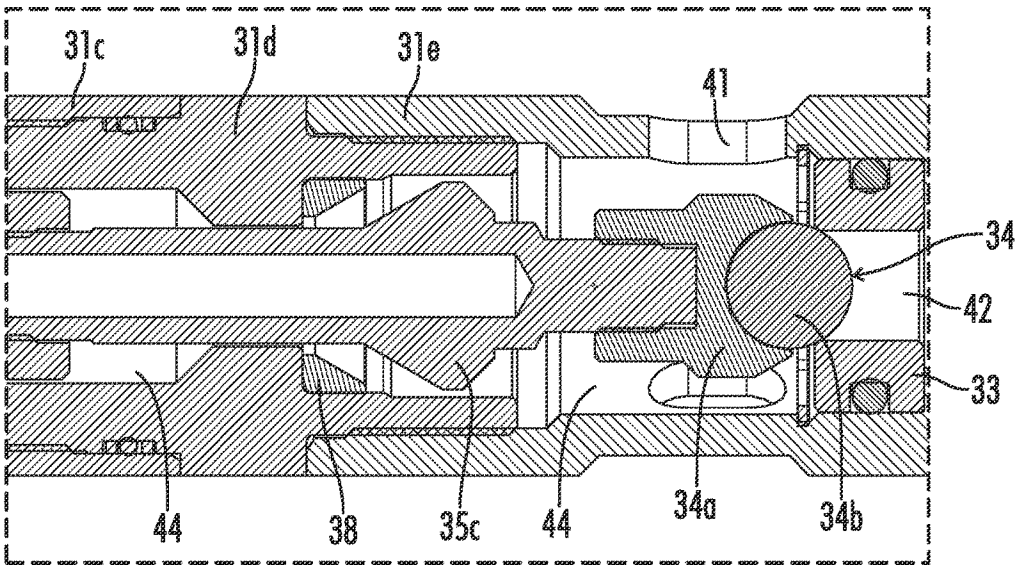
FIG. 7A is an enlarged view of portion 7A of FIG. 5A showing a lower seal body with gas injection valve 30 in its closed state.
Figure 7B:
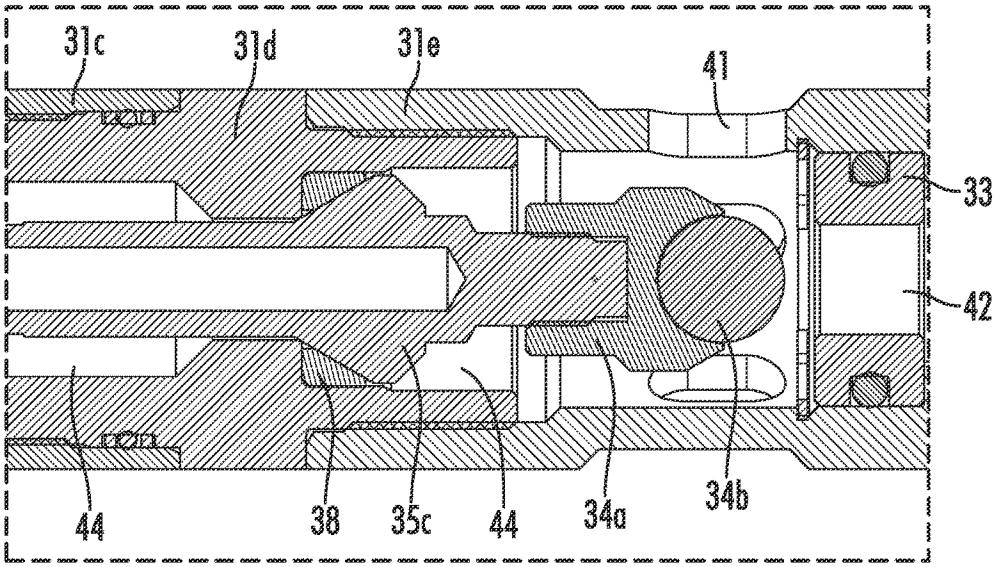
FIG. 7B is an enlarged view of portion 7B of FIG. 5B showing lower seal body with gas injection valve 30 in its open state.

Like upper seal body 37, lower seal body 38 preferably is an elastomer wedge seal. As best seen in FIGS. 7, lower seal body 38 preferably is mounted within housing 31, and valve stem assembly 35 has a surface providing a seat for lower seal body 38. For example, an area of reduced diameter in housing sub 31*d* provides a downward facing annular shoulder against which lower seal body 38 is mounted with its conically shaped sealing surface facing downwards. A radial enlargement on lower valve stem sub 35*c* provides an upward facing, truncated conical surface providing a seat for lower seal body 38. The conical surfaces of lower seal body 38 and on valve stem 35 may have angles as discussed above in reference to upper seal body 37. Like upper seal body 37, lower seal body 38 also may have other designs and geometries if desired and may be mounted on valve stem assembly 35 instead of in housing 31.

Upper seal body 37 and lower seal body 38 preferably are fabricated from a relatively hard, chemically inert, and heat resistant elastomer. For example, they may be made of a flouroelastomer and, preferably, a flouroelastomer with a filler, such as a molybdenum disulfide ($MoS_2$) or other mineral filler. Flouroelastomers such as polytetrafluoroethylene (PTFE) are tough, chemically resistant elastomers. The addition of fillers, such as glass fiber, carbon, graphite, and minerals, can enhance the elastomer's wear resistance and deformation characteristics. Molybdenum disulfide, for example, added in amounts from about 5 to about 15% can improve the hardness, stiffness, and wear characteristics of PTFE. Suitable elastomer seals are commercially available, for example, from DXP Enterprises, Inc., Houston, Texas (dxpe.com), Trelleborg Sealing Solutions, Houston, Texas (trelleborg.com/en/seals), and Parker Hannifin Corp., Stafford, Texas (parker.com/us/en/home.html).

As noted, valve seat 33 preferably is a removable sleeve. That not only allows for easy replacement in the event of excessive wear, but it enables the use of valve seats 33 with different orifice sizes for different flow rates. It is important that valve body 34 be lifted a sufficient distance off of valve seat 33 when valve 30 is fully open to allow unrestricted flow through the orifice. Otherwise, valve 30 may not provide the desired flow rate. Seal bodies 37 and 38 and the seal seats on stem cap 35*a* and lower stem sub 35*c*, therefore, will be dimensioned and distances such that when the seals are set and further upward travel of valve stem assembly 35 is precluded, valve body 34 will be distanced appropriately from valve seat 33.

Seal bodies 37 and 38 and the seal seat also may be dimensioned and distanced from each other so that the upper and lower seals are established essentially simultaneously. With that mode of operation, however, dimensional tolerances will be tight. If they are not met, there is a risk that both seals will not be set. For example, once the seal seat on lower stem sub 35*c* bears on lower seal body 38 and fully sets the lower seal, valve stem assembly 35 cannot move further upward, at least to any significant degree. If it has not already, stem cap 35*a* will not be able to set upper seal body 37 against the seal seat on stem stop 61. The upper seal likely will never be set.

Thus, the seal bodies and seal seats in the novel valves preferably will be dimensions and distanced from each other not only so that valve body 34 is appropriately distanced from valve seat 33, but also so that the valves will provide an upper seal slightly before the lower seal body provides a lower seal. For example, in valve 30 upper seal body 37 is adapted to set on stem cap 35*a* before lower seal body 38 seats on lower stem sub 31*c*. When the upper seal is set by upper seal body 37, the seal seat on lower stem sub 35*c* will be slightly off, slightly below lower seal body 38. Lock nuts 63 may be used to fine tune the sequence and timing of the setting of the upper and lower seal and the amount of clearance in the lower seal when the upper seal is set.

Once upper stem seal 37 sets the upper seal, liquid surrounding the exterior of bellows 32 is isolated from liquid and compressible gas in the upper portion of chamber 43. Being a liquid, the liquid plug surrounding bellows 32 is incompressible in theory. That theoretical incompressibility would protect bellows 32 from expanding in response to internal pressure. It also would prevent any further upward movement of valve stem assembly 35, thus preventing lower stem sub 35*c* from bearing on lower seal body 38 to create a lower seal. In practice, however, gas from the charge in upper chamber 43 dissolves into liquid surrounding bellows 32, rendering the liquid plug submerging bellows 32 slightly compressible. That slight compressibility allows a lower seal to be established after the upper seal is established, thus ensuring that both seals ultimately are set fully.

That is, the clearance between lower seal body 38 and the seat provided on lower stem sub 35*c* allows ambient fluid to enter the interior of bellows 32 after the upper seal is fully set. Fluid pressure within bellows 32 is allowed to build. Bellows 32 will expand slightly against the resistance of gas dissolved in the now isolated fluid plug in which it is submerged, and the resistance provided by Belleville washers 62. As bellows 32 expands, it will pull valve stem assembly 35 upwards. The seal seat on lower stem sub 35*c* will bear on lower seal body 38 and establish the lower seal.

In that regard, it will be appreciated that by providing a soft stop, stem stop assembly 36 reduces the risk that both seals will not be set. Belleville washers 62 essentially place an upper limit on the force required to establish the lower seal once the upper seal has been set. They will allow bellows 32 to expand slightly, and allow the seat on valve stem assembly 35 to bear on lower seal body 38 even if the isolated liquid plug on the exterior of bellows 32 has minimal dissolved gas and is virtually incompressible. Regardless, allowing upper seal body 37 to establish an upper seal before lower seal body sets the lower seal provides greater assurance that the redundant protection provided by the upper and lower seals will be achieved.

The bellows used in the novel valves, such as bellows 32, preferably are designed to tolerate pressure differentials between their exterior and interior to the greatest degree practical. Since they are essentially elastic vessels, they also should be capable of expanding and collapsing without failure over an extended service life. Preferably, they are resistant as well to the corrosive and deleterious effects of fluids in the well.

The bellows, therefore, preferably will be made of metal, such as titanium or stainless steel, or other high strength, corrosion resistant materials. The bellows typically is fabricated by forming, electroforming, or by welding individual metal diaphragms to each other. Welded metal bellows are generally preferred for applications requiring high strength, precision, sensitivity, and durability. For example, bellows 32 may be fabricated of three-ply Monel® steel diaphragms welded or silver brazed together at their edges. Bellows suitable for use in the novel valves are available commercially, for example, from Senior Flexonics Inc., Bartlett, Illinois (flexonics.com/), Alloy Precision Technologies, Mentor, Ohio (alloyprecisiontech.com/), MW Components (BellowsTech), Houston, Texas (mwcomponents.com), and Fulton Bellows LLC, Knoxville, Tennessee (fultonbellows-.com).

While there have been significant improvements in their design, as compared to fluid pressures encountered commonly in oil and gas wells, bellows for gas injection valves still are able to withstand relatively low pressure differentials. The hydrostatic head near 9 the bottom of a 10,000-foot-deep oil well, for example, typically will be around 4,000 psi. A highly rated formed bellows would have a maximum pressure differential rating of only about 600 psi. Thus, as a practical matter, some mechanism to protect it from excessive pressure, bellows valves can be installed only at relatively shallow depths. Conventional gas lift valves, therefore, have adopted various designs that incorporate either an upper seal or a lower seal to protect the bellows from excessive internal pressure.

In theory, either an upper seal or a lower seal should be sufficient. Whichever type of seal is chosen, so long as the seal holds, the bellows will be protected against excessive pressure. As discussed above, however, gas injection valves may be installed long before they are needed to commence gas lift operations. Well operators may view early installation as more expedient or as reducing overall costs. That means, however, that the valve in general, and its bellows and seals in particular may be required to withstand extremely high pressures and temperatures and tolerate corrosive well fluids over extended periods of time. Likewise, even if the valves are not installed until they are needed, gas lift operations may continue over extended periods of time. Seal failure is a distinct possibility. Seal failure in turn can allow rupturing or intolerable deformation of the bellows. Well fluids also may corrode the bellows and cause it to fail. Particulates in well fluids May accumulate within an injection valve and interfere with operation of the bellows per its design specifications.

It will be appreciated, therefore, that the novel gas injection valves and systems offer significant advantages over prior art systems and valves. By providing both an upper and a lower seal, the novel gas injection valves will reduce the risk that the valve will fail. The risk that the bellows will be damaged by excessive internal pressure and corrosive or other deleterious effects of well fluids is reduced. 2

For example, the lower seal provided by lower seal body 38 prevents fluid and particulates from circulating into the interior of bellows 32. The risk of significant accumulation of particulates is reduced. The lower seal also prevents excessive pressure from building within bellows 32. Such pressure otherwise might expand bellows 32 radially to the point where it is torn or deformed and is no longer able to expand and close valve 30. The upper seal established by upper seal body 37 creates a substantially incompressible plug of liquid around bellows 32. The plug of liquid will significantly limit any further expansion of bellows 32 if the lower seal established by lower seal body 38 fails. Likewise, should upper seal body 37 fail, lower seal body 38 still will provide protection for bellows 32. Thus, the novel valves provide redundant protection for the bellows not found in conventional valves.

Second Preferred Downhole Gas Control Valve

Figure 8:
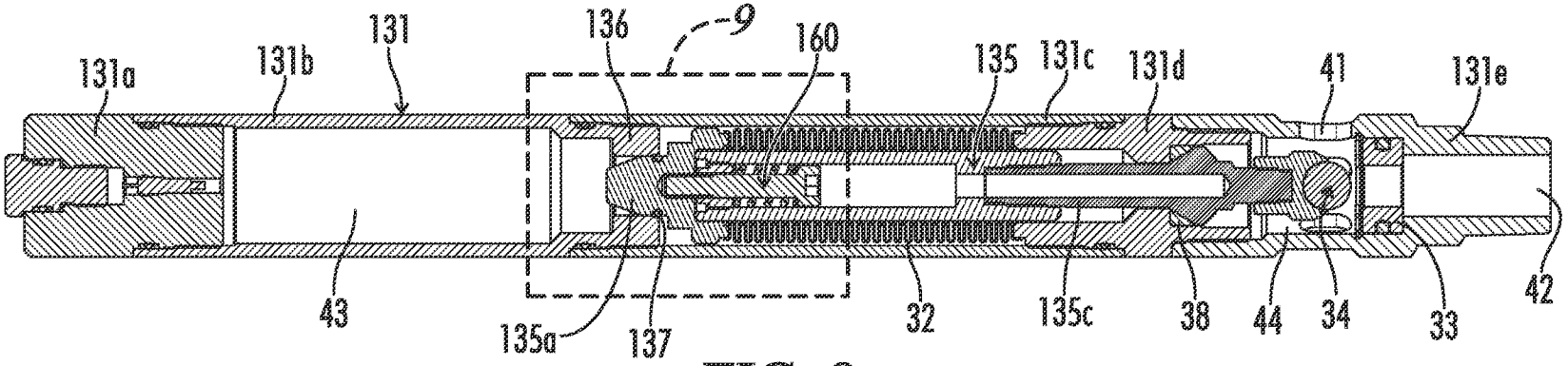
FIG. 8 is a longitudinal cross-sectional view of a second preferred embodiment 130 of the novel downhole gas injection valves of the subject invention showing gas injection valve 130 in its open state.
Figure 9:
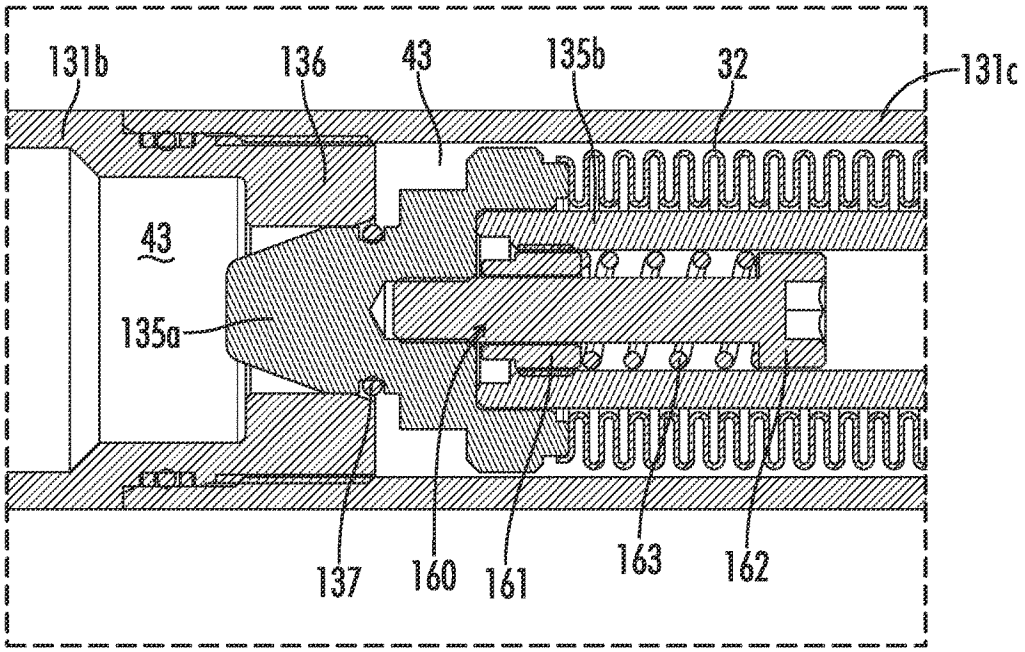
FIG. 9 is an enlarged view of portion 9 of FIG. 8 showing gas injection valve 130 in its open state and an upper seal body 137.

A second preferred embodiment 130 of the novel downhole gas control valves is shown in greater detail in FIGS. 8-9. Valve 130, like valve 30, is a gas injection valve. As may be seen in the figures, it generally comprises a housing 131, bellows 32, valve seat 33, valve body 34, a valve stem assembly 135, a stem stop 136, an upper seal body 137, and lower seal body 38.

As may be seen by comparing FIGS. 8-9 to FIGS. 3-7, valves 130 and valve 30 share many similarities. Bellows 32 and valve body 34 in valve 130 are operationally connected through valve stem assembly 135 such that injection valve 130 is normally closed by fluid pressure above bellows 32 and is opened by ambient fluid pressure below bellows 32. Bellows 32, valve seat 33, valve body 34, and lower seal body 38 are essentially identical to those in valve 30, as are certain components of housing 131 and valve stem assembly 135.

More particularly, housing 131 comprises five subs 131*a* to 131*e*. Housing subs 131*a*, 131*c*, 131*d*, and 131*e* are essentially identical, respectively, to housing subs 31*a*, 31*c*, 31*d*, and 31*e* of valve 30. Unlike housing sub 31*b* in valve 30, housing sub 131*b* of valve 130 comprises a fixed, integral stem stop 136. Like stem stop 61 in valve 30, stem stop 136 is adapted to limit upward movement of valve stem assembly 135 as it moves upward from its closed position toward its open position and lifts valve body 34 off valve seat 33.

Valve stem assembly 35 in novel valve 30 has a fixed length. Upper stem sub 35*b* and lower stem sub 35*c* are securely attached to each other and move together as a unit. The novel valves, however, may incorporate a stem assembly that is adapted to extend itself and increase in length. The extendable valve stem assembly comprises a first component and a second component coupled together to allow the components to move axially relative to each other.

For example, as shown in FIGS. 8-9, valve stem assembly 135 in novel valve 130 is adapted to extend itself. It comprises a stem cap 135*a*, an upper stem sub 135*b*, a lower stem sub 135*c*, and a stem cap mounting assembly 160. Lower stem sub 135*c* is essentially identical to lower stem sub 35*c* of valve 30. As in valve 30, bellows 32 is connected at its upper end to end cap 135*a* and at its lower end to housing sub 131*d*. Upper stem sub 135*b* and lower stem sub 135*c* are joined together, for example, by threaded connections. End cap 135*a*, however, is slidably mounted to the subassembly of upper stem sub 135*b* and lower stem sub 135*c*, for example, by stem cap mounting assembly 160. As discussed 16 further below, end cap 135*a* thus can move axially independently of the assemblage of stem subs 135*b* and 135*c*.

Stem cap mounting assembly 160 comprises a cap guide 161, a retainer bolt 162, and a resilient member, such as spring 163. Guide 161 is a short cylindrical sleeve mounted below stem cap 135*a* within upper stem sub 135*b*. Preferably, it is removably mounted by, for example, a threaded connection between its outer circumference and the inner circumference of upper stem sub 135*b*. Retainer bolt 162 is a threaded connector extending through guide 161 and threaded into a threaded, bottomed hole in stem cap 135*a*. Spring is a coiled compression spring. It is mounted under compression around retainer bolt 162 and between guide 161 and the head of retainer bolt 162.

Spring 163 thus biases stem cap 135*a* downward against the upper end of upper stem sub 135*b*. Stem cap 135*a*, however, can move axially upward as bellows 32 expands independently of the assemblage of upper stem sub 135*b* and 135*c*. As discussed further below, that will allow establishment of an upper seal in valve 130 in the event a lower seal fails. Other resilient members and mechanisms for biasing stem cap 135*a* against the rest of valve stem assembly 135 and allowing it to slide independently thereof, however, may be used if desired. 2

Upper seal body 137 preferably, as seen best in FIG. 9, is mounted on stem cap 135*a* of valve stem assembly 135. Stem stop 136 has a surface against which upper seal body 137 can seal. Upper seal body 137 is an annular elastomer seal, for example, an O-ring fabricated from materials such as those discussed above in reference to seal bodies 37 and 38. It is mounted in an annular gland or groove provided on stem cap 135*a*, for example, on an upper portion, what may be referred to as the "nose" of stem cap 135*a*. Stem stop 136 has a central passage. As described in detail below, when stem cap 135*a* moves upward into the central passage of stem stop 136, as described in further detail below, upper seal body 137 will seal against the cylindrical walls of the passage. While an O-ring is preferred, upper seal body 137 may have other designs and geometries and still provide an effective seal. Upper seal body 137, for example, may be a wedge seal and stem stop 136 may provide a conically shaped sealing surface. Upper seal body 137, if desired, also may be mounted on stem stop 136 and a seat provided on stem cap 135*a*. Other designs also may be used to provide the upper seal.

Like valve 30, valve 130 is designed to provide redundant protection against excessive pressure within bellows 32. Redundancy in valve 130, however, is provided on an "as needed" basis. That is, seal bodies 137 and 38 and the seal seats on stem cap 35*a* and lower stem sub 35*c* are dimensioned and distanced so that the lower seal is set and the upper seal sets only upon failure of the lower seal. In that sense, the upper seal may be viewed as a reserve seal.

FIGS. 8-9 show valve 130 in its open state. As may be seen in FIG. 8, the lower seal will be set once valve 130 opens fully. Lower seal body 38 will seat on lower valve stem 135*c*, thus setting the lower seal. As seen best in FIG. 9, however, the upper seal has not been set. When the lower seal is set, the nose of stem cap 135*a* will extend partially into the passage in stem stop 136. Upper seal body 137 is positioned just within the slightly flared lower portion of the passage. It will not yet engage stem stop 136 to set an upper seal. Fluid is still able to flow between clearances between the passage in stem stop 136 and upper seal body 137.

Valve 130 will remain in that state unless and until the lower seal fails and begins to allow fluid to leak into the interior of bellows 32. In that event, pressure within bellows 32 will increase, causing bellows 32 to expand axially. Stem cap 135*a* in turn will slide axially upwards against the biasing force of spring 163, sliding away from upper stem sub 135*b* and towards stem stop 136. If pressure within bellows 32 continues to increase, an upward facing shoulder on stem cap 135*a* eventually will bear against stem stop 136, limiting any further upward movement of stem cap 135*a*. Upper seal body 137 also will have been pushed into the passage in stem stop 136, thus setting the upper seal. Liquid submerging bellows 32 in the lower portion of upper chamber 43 is isolated from compressible gas in the upper portion of upper chamber 43, thus creating a substantially incompressible liquid plug around bellows 32.

It will be appreciated that novel valve 130, though described above as setting the upper seal only in the event of leakage through the lower seal, may be designed to operate in a fashion similar to novel valve 30. For example, seal bodies 137 and 38 and the seal seats on stem cap 35*a* and lower stem sub 35*c* may be dimensioned and distanced such that upper seal body 137 is allowed to fully seat and establish the upper seal at the same time or before the lower seal is set. In that event, the seal seat on lower stem sub 35*c* preferably will be slightly off lower seal body 38 initially and then allowed to set as gas dissolved in the liquid plug surrounding bellows 32 compresses. Regardless, however, it will be appreciated that novel valves 30 and 130 provide redundant protection for bellows 32 with significantly greater tolerances that would be essential for establishing both seals simultaneously.

Third Preferred Downhole Gas Control Valve

It will be appreciated that in both novel valve 30 and novel valve 130 the exterior of bellows 32 is exposed to fluid pressure in the sealed chamber and the interior of bellows 32 is exposed to ambient fluid pressure. That arrangement may be referred to as an "inverted" bellows design. The novel valves, however, may utilize a "standard" bellows design where the interior of the bellows is exposed to fluid pressure in the sealed chamber and the exterior of the bellows is exposed to ambient pressure.

Figure 10:
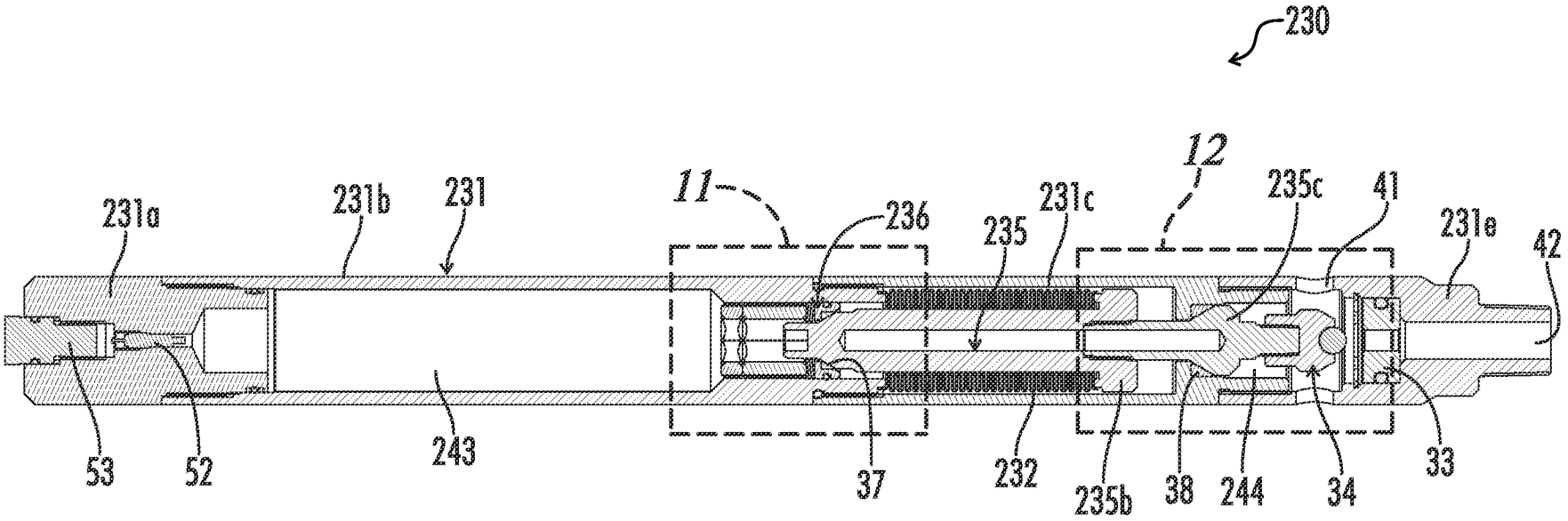
FIG. 10 is a longitudinal cross-sectional view of a third preferred embodiment 230 of the novel downhole gas injection valves of the subject invention showing gas injection valve 230 in its closed state.
Figure 11:
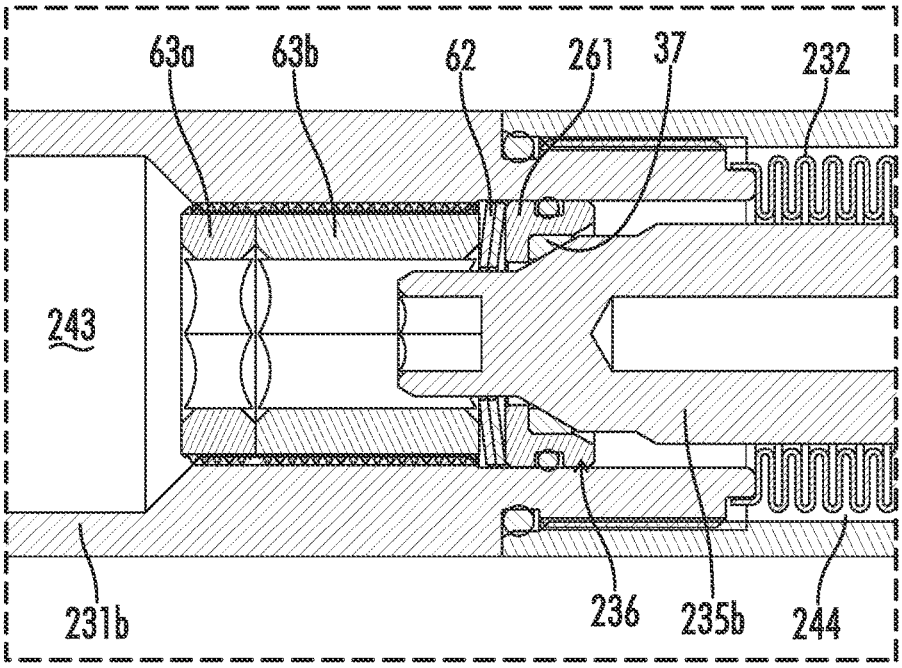
FIG. 11 is an enlarged view of portion 11 of FIG. 10 showing gas injection valve 230 in its closed state and an upper seal body 37.
Figure 12:
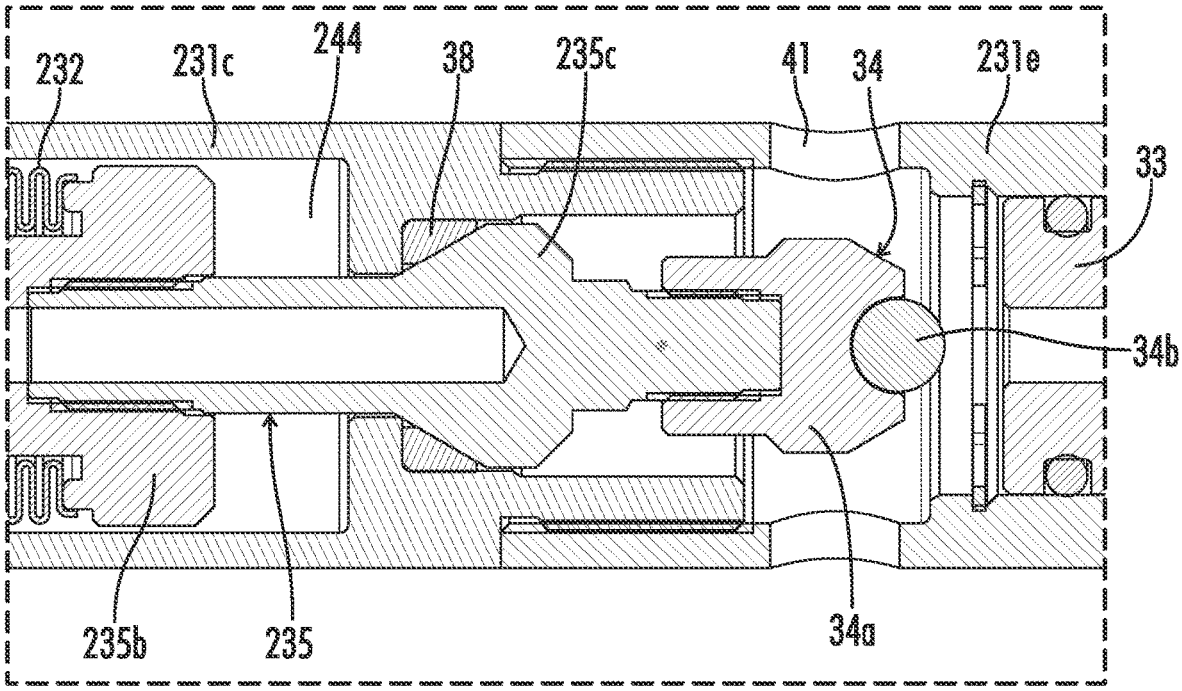
FIG. 12 is an enlarged view of portion 12 of FIG. 10 showing gas injection valve 230 in its closed state and a lower seal body 38.

For example, a third preferred embodiment 230 of the novel gas injection valves is shown in FIGS. 10-12. As may be seen therein, the design of valve 230 is similar to that of novel valves 30 and 130. It comprises a housing 231, a bellows 232, valve seat 33, valve body 34, a valve stem assembly 235, a stem stop assembly 236, upper seal body 37, and lower seal body 38.

As may be seen by comparing FIGS. 10-12 to FIGS. 3-7 and FIG. 8-9, valve 230 and valves 30 and 130 share many similarities. Bellows 232 and valve body 34 in valve 230 are operationally connected through valve stem assembly 235. Valve stem assembly 235 is mounted for axial reciprocation such that injection valve 230 is normally closed by fluid pressure above bellows 232 and is opened by ambient fluid pressure below bellows 232.

Valve seat 33, valve body 34, upper seal body 37, and lower seal body 38 in valve 230 are essentially identical to those in valve 30, as are certain components of housing 231 and valve stem assembly 235. Housing 231 comprises four subs 231: subs 231*a*, 231*b*, 231*c*, and 231*e*. Housing subs 231*a* and 231*e* are essentially identical, respectively, to housing subs 31*a* and 31*e* of valve 30. Valve seat 30 of valve 230 is carried in housing sub 231*e*. Valve stem assembly 235 comprises an upper stem sub 235*b* and a lower stem sub 235*c*. Lower stem sub 235*c* is essentially identical to lower stem sub 35*c* of valve 30. As in valve 30, valve body 35 of valve 230 is attached to the lower end of lower stem sub 235*c*. Lower seal body 38 is an elastomer wedge seal and is mounted within housing sub 231*c*. Lower stem sub 235*c* provides a truncated conical seal surface upon which lower seal body 38 will seat.

Bellows 232 of valve 230, however, is mounted in the standard configuration, while bellows 32 in valve 30 has an inverted configuration. That is, the interior of the bellows is exposed to fluid pressure in the sealed chamber and the exterior of the bellows is exposed to ambient pressure. More specifically, housing 231 and bellows 232 define a sealed, upper chamber 243 and an open, lower chamber 244. Bellows 232 is mounted at its upper end to housing sub 231*b* and at its lower end to the lower end of upper stem sub 235*b*. Sealed upper chamber 243, therefore, extends within housing sub 231*b* and downward into the interior of bellows 232. Open lower chamber 244 extends around the exterior of bellows 232 within housing sub 231*c* and downward into housing sub 231*e*.

Thus, the interior of bellows 232 is exposed to fluid pressure in sealed, upper chamber 243, and the exterior of bellows 232 is exposed to ambient fluid pressure outside valve 230. It will enlarge or collapse in response to pressure differentials across upper chamber 243 and lower chamber 244. When the effective dome pressure in upper chamber 243 exceeds the effective ambient pressure in lower chamber 244, bellows 232 will expand axially and place valve 230 in its closed state. It will collapse axially when the effective pressure in lower chamber 244 exceeds the preset effective dome pressure in upper chamber 243, thereby opening valve 230.

Stem stop assembly 236 in valve 230 is similar to stem stop assembly 36 in valve 30. It is adapted to provide a soft stop limiting upward movement of valve stem assembly 235. It generally comprises stem stop 261, Belleville washers 62, and lock nuts 63. Stem stop 261 has a generally annular shape and is slidably mounted in housing sub 231*b*. Belleville washers 62 are sandwiched between stem stop 261 and lock nuts 63 and bias stem stop 261 in a downward position.

As in valve 30, upper seal body 37 in valve 230 is an elastomer wedge seal. In contrast to the arrangement in valve 30, upper seal body 37 in valve 230 is mounted on stem stop 261 of stem stop assembly 236. Upper stem sub 235*b* has a truncated conical surface at its upper end upon which upper seal body 37 may seat.

Otherwise, valve 230 operates in a fashion similar to novel valve 30. As with valve 30, if desired, seal bodies 37 and 38 and the seal seats on upper stem sub 235*b* and lower stem sub 235*c* in valve 230 may be dimensioned and distanced from each other so that the upper and lower seals are established essentially simultaneously. Preferably, however, an upper seal will be set first as bellows 232 collapses and valve 230 opens. Valve stem assembly 235 is pulled upwards by collapsing bellows 232. The seal surface on upper stem sub 235*b* bears on upper seal body 37 mounted on stem stop 261. When the upper seal is set, it isolates a liquid plug in the interior of bellows 232. The seal surface on lower stem sub 235, however, preferably will be slightly below lower seal body 38. The liquid plug in the interior of bellows 232 largely precludes any further collapsing of bellows 232. As dissolved gas in the liquid plug is compressed, however, or as stem stop 261 is urged upward against the resistance of Belleville washers 62, the seal surface on lower stem sub 235*c* will move upward and set the lower seal. As in valve 30, lock nuts 63 may be used to adjust the position of stem stop assembly 236 and thereby ensure that setting of the upper and lower seals is sequenced and timed appropriately.

Gas lift system 20 and other embodiments have been described as installed in a casing and, more specifically, a production casing used to fracture a well in various zones along the wellbore. A "casing," however, can have a fairly specific meaning within the industry, as do "liner" and "tubing." In its narrow sense, a "casing" is generally considered to be a relatively large tubular conduit, usually greater than 4.5" in diameter, that extends into a well from the surface. A "liner" is generally considered to be a relatively large tubular conduit that does not extend from the surface of the well, and instead is supported within an existing casing or another liner. In essence, a "liner" is a "casing" that does not extend from the surface. "Tubing" refers to a smaller tubular conduit, usually less than 4.5" in diameter. The novel systems and pumps, however, are not limited in their application to casing as that term may be understood in its narrow sense. They may be used to advantage in liners, casings, and perhaps even in smaller conduits or "tubulars" as are commonly employed in oil and gas wells. A reference to casings shall be understood as a reference to all such tubulars.

While this invention has been disclosed and discussed primarily in terms of specific embodiments thereof, it is not intended to be limited thereto. For example, preferred embodiments of the novel valves have been described in the context of gas lift systems where liquids are produced through a production tube. That is, the valves are used to inject gas, either continuously or intermittently, into a production tube allowing liquids to flow upwards through the production tube. Operators, however, may prefer to produce liquids through the annulus. The valves in such systems inject gas through a production tube into the annulus and allow production liquids to flow up the annulus. The novel gas injection valves may be used in such systems as well. And while they are described as allowing flow between a production tube and the annulus, they may be used to control the flow of gas between other portions or tools in the well. They may be used, for example, to control gas flow into and out of a gas pump. Other modifications and embodiments will be apparent to the worker in the art.

What is claimed is:

1. A downhole valve for controlling flow of gas through a gas lift system for producing liquids from an oil and gas well, said downhole gas control valve comprising:

(a) a valve housing having an inlet and an outlet;

(b) a fluid flowpath extending from said inlet to said outlet;

(c) a bellows mounted within said housing and having an exterior and an interior;

(d) a sealed chamber on the exterior of said bellows, said sealed chamber being adapted to be filled with a liquid and a compressed gas, whereby said liquid fills a lower portion of said sealed chamber extending around the exterior of said bellows and said gas fills an upper portion of said sealed chamber;

(e) a valve stem extending through the interior of said bellows and mounted for axial reciprocation in said valve housing;

(f) a valve body on a lower end of said valve stem;

(g) a valve seat in said flowpath;

(h) an upper seal body; and (i) a lower seal body;

(j) wherein:

i) the exterior of said bellows is exposed to fluid pressure in said sealed chamber and the interior of said bellows is exposed to ambient fluid pressure;

ii) said bellows is adapted to collapse linearly when sealed chamber fluid pressure on its exterior is effectively greater than ambient pressure on its interior and is adapted to expand linearly when said ambient fluid pressure on its interior is effectively greater than said sealed chamber fluid pressure on its exterior;

iii) said valve stem is coupled to said bellows and reciprocates as said bellows collapses and expands to move between a closed position, in which closed position said valve body is seated on said valve seat and said valve is placed in a closed state, and an open position, in which open position said valve body is lifted off said valve seat and said valve is placed in an open state;

iv) said upper seal body is adapted to provide, in response to expansion of said bellows, an upper seal to isolate liquid in said lower portion of said sealed chamber from fluid pressure in said upper portion of said sealed chamber, said isolated liquid providing a liquid plug on the exterior of said bellows; and v) said lower seal body is adapted to provide, in response to expansion of said bellows, a lower seal isolating the interior of said bellows from ambient fluid pressure.

2. The valve of claim 1, wherein said valve comprises a stem stop adapted to limit upward movement of said valve stem when said valve is in its open state.

3. The valve of claim 1, wherein said upper seal body provides said upper seal before said lower seal body provides said lower seal.

4. The valve of claim 3, wherein said lower seal body provides said lower seal in response to fluid pressure on the interior of said bellows and compression of dissolved gas in said liquid plug in said lower portion of said sealed chamber.

5. The valve of claim 3, wherein:

(a) said lower seal body is proximate to and establishes clearance from a lower seal seat when said upper seal body engages an upper seal seat to establish said upper seal;

(b) said clearance between said lower seal body and said lower seal seat allows fluid pressure to increase in the interior of said bellows;

(c) said bellows is adapted to expand further in response to said increase in fluid pressure in its interior and to compression of dissolved gas in said liquid plug in said lower portion of said sealed chamber;

(d) whereby said valve stem is adapted to move upward in response to said further expansion of said bellows to seat said lower seal on said lower seal seat and to provide said lower seal.

6. The valve of claim 2, wherein said stem stop is mounted in said housing for axial movement.

7. The valve of claim 6, wherein said valve comprises a stem stop assembly, said stem stop assembly comprising:

(a) said stem stop;

(b) a retainer mounted in said housing above said stem stop; and (c) a resilient member mounted between said stem stop and said retainer, said resilient member biasing said stem stop downward.

8. The valve of claim 1, wherein said lower seal body provides said lower seal before said upper seal body provides said upper seal.

9. The valve of claim 8, wherein said upper seal body provides said upper seal in response to fluid leaking through said lower seal.

10. The valve of claim 8, wherein:

(a) said upper seal body is proximate to and has clearance from an upper seal seat when said lower seal body engages a lower seal seat to establish said lower seal; and (b) said bellows is adapted to expand further in response to fluid leaking through said lower seal and a resulting increase in fluid pressure on its interior side;

(c) whereby said valve stem is adapted to move upward in response to said further expansion of said bellows to seat said upper seal body on said upper seal seat to provide said upper seal.

11. The valve of claim 1, wherein said valve stem comprises a first component coupled to a second component, said coupling allowing said first and second components to move axially relative to each other.

12. The valve of claim 11, wherein:

(a) said first component is a stem cap attached to the upper end of said bellows;

(b) said second component is a stem sub; and (c) wherein said coupling comprises;

i) a guide affixed to said stem sub;

ii) a retainer bolt extending through said guide and threaded into said stem cap; and iii) a resilient member extending between said guide and a head on said retainer bolt.

13. The valve of claim 1, wherein said valve stem comprises a stem cap assembly, said stem cap assembly comprising:

(a) a stem cap;

(b) a guide insert coupled to said valve stem below said stem cap;

(c) a retainer extending through said insert and engaging said stem cap;

(d) a resilient member mounted between said insert and said retainer such that said stem cap is biased downward.

14. A gas lift system for producing liquids from a well, said gas lift system comprising:

(a) production tubing adapted to convey fluid from said well to the surface;

(b) a plurality of gas injection valves of claim 1 installed on said production tubing and adapted to control the flow of gas between an annulus surrounding said production tubing and said production tubing.

15. A downhole valve for controlling flow of gas through a gas lift system for producing liquids from an oil and gas well, said downhole gas control valve comprising:

(a) a valve housing having an inlet and an outlet;

(b) a fluid flowpath extending from said inlet to said outlet;

(c) a bellows mounted within said housing and having an exterior and an interior;

(d) a sealed chamber on the interior of said bellows, said sealed chamber being adapted to be filled with a liquid and a compressed gas, whereby said liquid fills a lower portion of said sealed chamber extending into the interior of said bellows and said gas fills an upper portion of said sealed chamber;

(e) a valve stem extending through the interior of said bellows and mounted for axial reciprocation in said valve housing;

(f) a valve body on a lower end of said valve stem;

(g) a valve seat in said flowpath;

(h) an upper seal body; and (i) a lower seal body;

(i) wherein:

i) the interior of said bellows is exposed to fluid pressure in said sealed chamber and the exterior of said bellows is exposed to ambient fluid pressure;

ii) said bellows is adapted to expand linearly when sealed chamber fluid pressure on its interior is effectively greater than ambient pressure on its exterior and is adapted to collapse linearly when said ambient fluid pressure on its exterior is effectively greater than said sealed chamber fluid pressure on its interior;

iii) said valve stem is coupled to said bellows and reciprocates as said bellows expands and collapses to move between a closed position, in which closed position said valve body is seated on said valve seat and said valve is placed in a closed state, and an open position, in which open position said valve body is lifted off said valve seat and said valve is places in an open state;

iv) said upper seal body is adapted to provide, in response to collapsing of said bellows, an upper seal to isolate liquid in said lower portion of said sealed chamber from fluid pressure in said upper portion of said sealed chamber, said isolated liquid providing a liquid plug on the interior of said bellows; and v) said lower seal body is adapted to provide, in response to collapsing of said bellows, a lower seal isolating the exterior of said bellows from ambient fluid pressure.

16. The valve of claim 15, wherein said upper seal body provides said upper seal before said lower seal body provides said lower seal.

17. The valve of claim 16, wherein said lower seal body provides said lower seal in response to fluid pressure on the exterior of said bellows and compression of dissolved gas in said liquid plug in said lower portion of said sealed chamber.

18. The valve of claim 16, wherein:

(a) said lower seal body is proximate to and establishes clearance from a lower seal seat when said upper seal body engages an upper seal seat to establish said upper seal;

(b) clearance between said lower seal body and said lower seal seat allows fluid pressure to increase on the exterior of said bellows;

(c) said bellows is adapted to collapse further in response to said increase in fluid pressure on its exterior and to compression of dissolved gas in said liquid plug in said lower portion of said sealed chamber;

(d) whereby said valve stem is adapted to move upward in response to said further collapsing of said bellows to seat said lower seal on said lower seal seat and to provide said lower seal.

19. The valve of claim 15, wherein said valve comprises a stem stop adapted to limit upward movement of said valve stem when said valve is in its open state.

20. The valve of claim 19, wherein said upper seal body is mounted on said stem stop and said valve stem comprises a seat for said upper seal body.

21. The valve of claim 19, wherein said stem stop is mounted in said housing for axial movement.

22. The valve of claim 21, wherein said valve comprises a stem stop assembly, said stem stop assembly comprising:

(a) said stem stop;

(b) a retainer mounted in said housing above said stem stop; and (c) a resilient member mounted between said stem stop and said retainer, said resilient member biasing said stem stop downward.

23. A gas lift system for producing liquids from a well, said gas lift system comprising:

(a) production tubing adapted to convey fluid from said well to the surface;

(b) a plurality of gas injection valves of claim 15 installed on said production tubing and adapted to control the flow of gas between an annulus surrounding said production tubing and said production tubing.

* * * * *